US006425821B1

(12) United States Patent
Koerber et al.

(10) Patent No.: US 6,425,821 B1
(45) **Date of Patent: *Jul. 30, 2002**

(54) PORE-CONTAINING WEB FOR DIFFUSING FLUIDS

(75) Inventors: Keith G. Koerber, Goffstown; John Effenberger, Bedford, both of NH (US); Christopher Comeaux, Somerville, MA (US)

(73) Assignee: ChemFab Corporation, Merrimack, NH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/522,988

(22) Filed: Mar. 10, 2000

Related U.S. Application Data

(63) Continuation-in-part of application No. 09/037,470, filed on Mar. 10, 1998, now Pat. No. 6,139,426, which is a continuation-in-part of application No. 08/975,430, filed on Nov. 20, 1997, now Pat. No. 6,059,655, which is a continuation-in-part of application No. 08/590,102, filed on Jan. 24, 1996, now Pat. No. 5,725,427, and a continuation-in-part of application No. 08/975,430, which is a continuation-in-part of application No. 08/590,102.

(51) Int. Cl.[7] ..... F24F 13/068
(52) U.S. Cl. ..... 454/296; 454/906
(58) Field of Search ..... 454/284, 296, 454/297, 298, 906; 181/224

(56) References Cited

U.S. PATENT DOCUMENTS

| | | | | |
|---|---|---|---|---|
| 2,172,944 | A | 9/1939 | Norris | 454/296 X |
| 2,329,102 | A | 9/1943 | Chipley | 454/296 X |
| 3,058,411 | A | 10/1962 | Hanson et al. | 454/296 |
| 3,084,609 | A | 4/1963 | Onstad | |
| 3,264,972 | A | 8/1966 | Averill et al. | |
| 3,835,758 | A | 9/1974 | Bean | |
| 3,948,155 | A | 4/1976 | Hedrick | |
| 4,152,474 | A | 5/1979 | Cook et al. | 428/137 |
| 4,266,470 | A | 5/1981 | Schroeder et al. | |
| 4,366,748 | A | 1/1983 | Wilson et al. | |
| 4,371,386 | A | 2/1983 | DeVecchi | 454/296 X |
| 4,603,618 | A | 8/1986 | Soltis | |
| 4,709,443 | A | 12/1987 | Bigley | 55/DIG. 3 X |
| 4,861,353 | A | 8/1989 | Wyss | 55/302 X |
| 4,898,087 | A | 2/1990 | Fitzner et al. | 454/296 |
| 5,054,379 | A | 10/1991 | Sodec | |
| 5,192,348 | A | 3/1993 | Ludwig | 55/385.2 |
| 5,207,614 | A | 5/1993 | Passadore | 454/298 |
| 5,454,756 | A | 10/1995 | Ludwig | 454/296 |
| 5,782,689 | A | 7/1998 | Woolsey et al. | 454/296 |

*Primary Examiner*—Harold Joyce
(74) *Attorney, Agent, or Firm*—White & Case LLP

(57) ABSTRACT

A fluid diffuser and a method for diffusing fluid are provided. In one preferred embodiment, the diffuser comprises a frame adapted to be connected to the end of fluid supply duct. Mounted within the frame is a pore-containing web. The web redirects fluid passing through the pores by changing the direction of the fluid upon exiting the web. Prescribed portions of the web can be blocked to expel fluid preferentially in one direction and expel fluid less in other directions. Other means for controlling the direction and flow of fluid upon exiting the web are provided, including changing the angle of fluid supply to the web, and placing a vane at the entrance to the web.

42 Claims, 18 Drawing Sheets

PORE-CONTAINING WEB FOR DIFFUSING FLUIDS

This application is (i) a continuation-in-part of application Ser. No. 09/037,470, filed on Mar. 10, 1998 (U.S. Pat. No. 6,139,426) which is a continuation-in-part of application Ser. No. 08/975,430, filed on Nov. 20, 1997, now U.S. Pat. No. 6,059,655 which is a continuation-in-part of application Ser. No. 08/590,102 filed on Jan. 24, 1996 (U.S. Pat. No. 5,725,427); and (ii) a continuation-in-part of application Ser. No. 08/975,430, which is a continuation-in-part of application Ser. No. 08/590,102 (U.S. Pat. No. 5,725,427).

FIELD OF THE INVENTION

The present invention relates generally to materials that diffuse flowing fluids into a dispersed pattern. In particular, the invention relates to air diffusers for environmental control systems in commercial and residential buildings. More specifically, the invention relates to a fabric air diffuser or a molded diffuser that can be used in place of conventional diffusers. The invention also relates to a method for diffusing air and a method for attenuating the noise associated with flowing air. The invention contemplates the use of any woven fabric or molded material having the shape and geometry described herein. The present invention has additional applications generally involving controlling the flow of fluids in general from both enclosed and unenclosed spaces.

BACKGROUND OF THE INVENTION

Air diffusing systems are designed to redirect air that is supplied from a duct in the ceiling of the enclosed environment. In general, it has been known that air diffusers redirect air as it flows into a room from a ceiling mounted supply duct. Without a diffuser, the air provided by the duct will flow straight down into the room. This can cause undesirable air drafts or turbulence within the room, as well as poor thermal mixing, and poor changeover of room air.

The prior art diffusers solve this and other problems by redirecting and diffusing the air as it enters the room. To accomplish this goal, the exit "face" of a typical prior art diffuser has an associated group of angled vanes or louvers to alter the air flow direction. In addition or alternatively, directional devices may be found inside the duct above or behind the outlet portion of the system.

Prior art diffusers that utilize angled vanes or louvers include those set forth in U.S. Pat. No. 3,948,155, issued Apr. 6, 1976 (Warren R. Hedrick), U.S. Pat. No. 4,266,470, issued May 12, 1981 (Schroeder et al.), U.S. Pat. No. 4,366,748, issued Jan. 4, 1983 (Wilson et al.), U.S. Pat. No. 5,054,379, issued Oct. 8, 1991 (Franc Sodec), U.S. Pat. No. 5,192,348, issued Mar. 9, 1993 (Craig S. Ludwig), and U.S. Pat. No. 5,454,756, issued Oct. 3, 1995 (Craig S. Ludwig).

Fabric sheets have been used in diffuser systems to filter dust and other particulate matter from the air passing into the room. U.S. Pat. No. 4,603,618, issued Aug. 5, 1986 (Charles W. Soltis), discloses a clean room ventilation system having a fabric sheet fixed above a perforated ceiling grid. The fabric sheet filters the air and provides a uniform laminar flow of air into the room. The fabric sheet and perforated grid extend across the entire ceiling, and air flows from the ceiling straight down into the room.

The prior art air diffusers have many problems. They often accumulate dust, which tends to build up around the angled vanes. In addition, the prior art air distribution systems tend to be noisy.

Fabrics have also been used to absorb sound. U.S. Pat. No. 4,152,474, issued May 1, 1979 (Cook, deceased et al.), discloses an acoustic absorber which comprises a substrate having a plurality of openings. An organic polymer coating covers the substrate and partially fills the openings in the substrate.

It is an object of this invention to provide a pore-containing sheet or web for changing the flow of a fluid. A fluid flowing into the web at an angle essentially normal to the web surface is redirected as it passes through the web. The fluid exits the web surface in a direction that is lateral to the web surface and radially outward from the center of the web.

Another object of the invention is to provide a diffusion web that significantly reduces the noise commonly associated with the passage of air through a diffusion system, particularly as produced by the angled vane type diffusers.

A further object of this invention is to provide a means for altering the radial distribution of the fluids redirected by the web. By angling the feed duct or blocking a prescribed portion of the web, it is possible to control the radial pattern of thrown fluid to make it non-uniform in directionality while still essentially radial and laterally outward from the diffusing web.

Further objects of the invention include a variety of new end use applications for the pore-containing web diffuser. By varying the material making up the diffuser and choosing a particular geometry for that material, it has been found that the diffuser may be used for many different end uses involving the redirection of fluids passing through the diffuser. The invention also has applications for controlling the flow of fluids where the fluids flow from both enclosed and unenclosed spaces.

SUMMARY OF THE INVENTION

The present invention concerns a pore-containing web material that has the ability to diffuse fluids passing therethrough. In one embodiment of the invention, the pore-containing web is composed of a fabric sheet that is employed as an air diffuser. In this embodiment, the diffuser includes a frame adapted to be connected to the end of an fluid (air) supply duct. The fabric sheet changes the direction of air flow upon exiting the sheet. More particularly, the fabric sheet redirects and scatters air flowing into the sheet. Upon exiting the weave openings, the air flows laterally to the sheet and radially outward from the sheet in all directions. The degree of lateral deflection depends on flow rate, weave opening size, and fabric thickness, as well as the properties of the fluid itself, such as density.

The pore-containing web may be constructed from a variety of materials, including for example, glass fibers such as fiberglass (a non-combustible material), nylon, plastics, elastomer, polyester, polyvinyl chloride (PVC), polyethylene, polypropylene, polyether ether ketone (PEEK), polyether ketone ketone (PEKK), acrylic polymers, polystyrene, acrylonitrile/butadiene/stryene rubber (ABS), polyphenyl sulfide (PPS), polyaramid, fibrillated polytetrafluoroethylene (PTFE), metal, ceramics, carbon fibers and woven and nonwoven natural and synthetic fibers and blends thereof.

The pore-containing web optionally may be coated with a material including, for example, halogenated and non-halogenated plastics, silicone, epoxy, polyimide, polyamide, elastomer, nitrilerubber (NHBR), neoprene, ethylene/propylene/dienerubber (EPDM), any thermoplastic elastomer, polyurethanes and aqueous or solvent based polymer coatings.

The web may be coated with a soil resistant material. A soil-resistant material, such as polytetrafluoroethylene (PaTE), inhibits adherent dust and other particulate matter from accumulating on the fabric and, therefore, eases cleaning the diffuser. Other flouropolymers may be used, including a copolymer of tetrafluoroethylene and hexafluoropropylene (FEP), polyvinylindene fluoride (PVDF), copolymers of tetrafluoroethylene and perfluorinated alykyl vinyl ethers (PFA), terpolymers of tetrafluoroethylene, hexafluoropropylene, and vinylidene fluoride (THV), polychlorotrifluoroethylene (PCTFE), fluoroelastomer (FKM) and perfluoroelastomer (FFKM).

Other surface treatments may be applied to reduce accumulation of particulate matter, inhibit biological growth, and/or prevent degradation. Such surface treatments include surface active agents, biocides (e.g., Dowicide® made by Dow), fluorinated surfactants, antistatic coatings, water and/or stain repellent coatings (e.g., fluoroacrylates such as Scotchguard® made by 3M and Zonyl® made by DuPont), coatings capable of generating heat, heat and/or electrically conductive coatings and dyes.

A further aspect of the invention is that the pore-containing web diffuser can be used for attenuating the noise associated with a fluid (such as air) flowing through a defined volume (such as an air duct). By disposing the pore-containing web (such as an open-weave, fabric sheet) across an entire cross-sectional area of the volume, the web attenuates the noise that is generated by the fluid passing through the diffuser system, as well as any noise generated prior to the diffuser system.

Where the pore-containing web comprises a fabric diffuser for air, the diffuser may be used in place of a conventional, angled-vane diffuser which typically generates a substantial noise as air passes by the vanes. The fabric air diffuser may be employed in a variety of air distribution systems, such as, heating/cooling/ventilation (HVAC) systems.

In the case where the pore-containing web is a fabric sheet for diffusing air, the air flowing from the duct into the woven sheet or web is angularly deflected and flows radially away from the "center" of the exit face of the web. The externally supplied diffused air and the "standing" room air in front of the exit face collide and mix and flow parallel and radially outward from the web. The invention provides multiple advantages in the realm of air diffusers as well as other potential fluid directing applications. It is the intent of the invention to achieve the lateral direction change and radial pattern for a fluid, particularly air, flowing from a supply reservoir.

In another embodiment of the invention, the pore-containing web of the invention comprises a molded plastic diffusing web. In an air duct application, the molded plastic air diffusing web is installed at the end of an air duct controllably supplying air to an enclosed environment, such as a room or hall.

The plastic molded web of the present invention has an array of numerous openings occupying about 60% of the molded web area, more preferably about 50% of the molded web area or most preferably about 35% of the molded web area. The openings are preferably in-plane with the surface of the molded web. The degree of lateral deflection depends on flow rate, opening size and molded web thickness. The web is formed by compression molding, thus forming a frontal face and a rear face which preferably are used as the entry and the exit surface, respectively.

The molded web may be constructed of a variety of polymeric or non-polymeric materials including plastics, elastomers, fluoroplastics, fluoroelastomers, polyester, PVC, polyethylene, polypropylene, PEEK, PEKK, acrylic polymers, polystyrene, ABS, PPS, and metals or blends thereof In one embodiment, the molding polymer is preferably a thermoplastic and can be treated to be dust repellent and soil and corrosion resistant. A thin coating layer with these attributes can be applied to the molded diffuser web. The coating layer may be composed of halogenated and non-halogenated plastics, silicone, epoxy, polyimide, polyamide, elastomer, NHBR, neoprene, EPDM, any thermoplastic elastomer, polyurethanes and aqueous or solvent based polymer coatings. Particular fluoropolymer coatings include FEP, PFDF, PFA, THV, PCTFE, FKM and FFKM. Certain surface treatments are applied to reduce accumulation of particulate matter, inhibit biological growth, prevent oxidation, and/or prevent degradation. Such surface treatments include surface active agents, biocides (e.g., Dowicide® made by Dow), fluorinated surfactants, antistatic coatings, water and/or stain repellent coatings (e.g., fluoroacrylates such as Scotchguard® made by 3M and Zonyl® made by DuPont), coatings capable of producing heat, heat and/or electrically conductive coatings and dyes.

The molded web may also be used to redirect a fluid flowing into one face and exiting the other face of the web by forcing the fluid to flow laterally and radially outward from the center of the web as the fluid passes through the exit face of the web. For example, air flowing from a duct into the molded sheet or web is angularly deflected and flows radially away from the "center" of the exit face. The externally supplied diffused air and the "standing" room air in front of the exit face collide and mix and flow parallel and radially outward. It should be noted that for this described phenomenon to occur, the molded sheet must be of a unique aperture configuration, and one not unlike the fabric sheet described above. The face of the molded sheet is planar as a function of molding, and it can be molded in such a way that the geometry of the part helps maintain the flatness of the part, for example, by molding a rib pattern onto the back side of the web. A stiff, yet moldable, web material (for example a metal wire, either as the web, or as part of the web) could also be used to maintain flatness in the web, or could be used for maintaining the web in a non-planar shape if such was desired. The rigid frame can be an integral part of the surface in a compression molded assembly. It is the intent of this invention to achieve the lateral direction change and radial pattern for air flowing from a supply duct into the web exiting from the planar web surface.

BRIEF DESCRIPTION OF THE DRAWINGS

FIG. 4 shows the air existing the sheet laterally from the plane of the sheet.

FIG. 5 shows the air exiting the sheet radially in all directions.

FIG. 9A shows the air exiting the diffuser sheet laterally from the plane of the sheet.

FIG. 9C shows the change in direction of air exiting the partially blocked diffuser in a direction lateral to the plane of the diffuser.

DETAILED DESCRIPTION OF THE INVENTION

Figure 1:
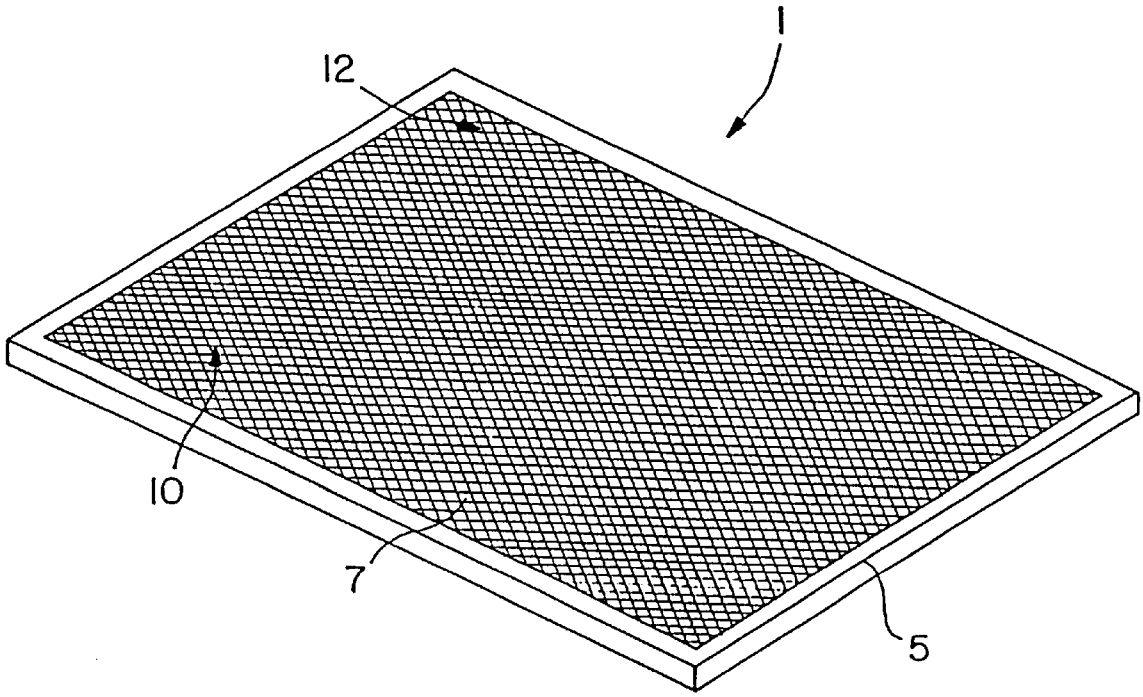
FIG. 1 is a perspective view of a first embodiment of the invention where the pore-containing web is composed of a fabric sheet diffuser for redirecting the flow of air.

Referring to FIG. 1, in a preferred embodiment, the pore-containing web of the invention comprises a fabric diffuser 1 for diffusing air. The fabric diffuser includes a fabric sheet 7 mounted in a rectangular frame 5 adapted to be connected to the end of a typical air supply duct. Although the diffuser of FIG. 1 is rectangular in shape, the diffuser of the invention may be of any shape, including square, triangular, octagonal, circular, elliptical, etc. The fabric sheet is preferably flat, open-weave and constructed of a glass material, such as fiberglass. However, the fabric may be constructed from a variety of other materials, such as nylon, plastics, elastomer, polyester, PVC, polyethylene, polypropylene, PEEK, PEKK, acrylic polymers, polystyrene, ABS, PPS, wire, Polyaramid, fibrillated PTE, metal, ceramics, carbon fibers and woven and nonwoven natural and synthetic fibers and blends thereof. The yarns of the fabric sheet 7 are preferably coated with a soil-resistant material (shown as dots in FIG. 2). The coating does not completely fill in the open-weave area of the fabric sheet 7. Thus, a substantial open area is maintained in the sheet. The soil-resistant material is preferably a fluoropolymer, such as polytetrafluoroethylene (PTFE), although other low surface energy polymers, such as fluoropolymers, may also be employed. Particular fluoropolymer coatings include FEP, PVDF, PFA, THV, PCTFE, FKM and FFKM. The coating may also be composed of other materials, such as halogenated and non-halogenated plastics, silicone, epoxy, polyimide, polyamide, elastomer, NHBR, neoprene, EPDM, any thermoplastic elastomer, polyurethanes and aqueous or solvent based polymer coatings.

Figure 1A:
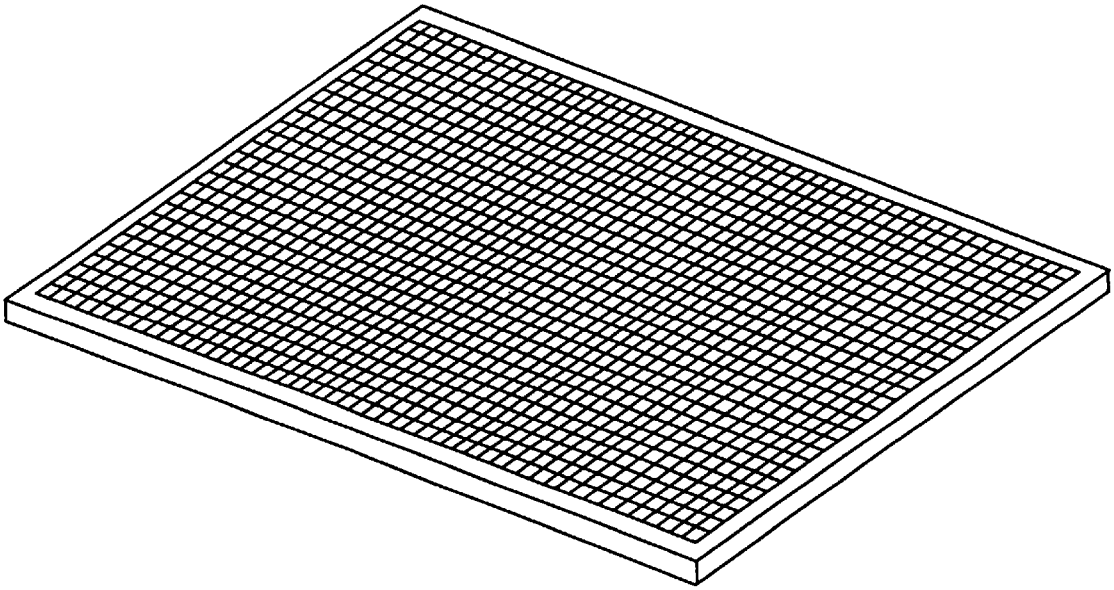

The fabric sheet 7 is constructed of interwoven warp and fill yarns 10 and 12, respectively, that are typically perpendicular to each other. In the embodiment shown in FIG. 1, the warp and fill yarns 10 and 12, respectively, extend diagonally across the rectangular frame 5. However, the yarns may also be aligned parallel to the edges of the frame (See FIG. 1A). The diagonal orientation of the yarns can simplify mounting the fabric within the frame, but the orientation may vary to create the desired aesthetic effect.

Figure 2:
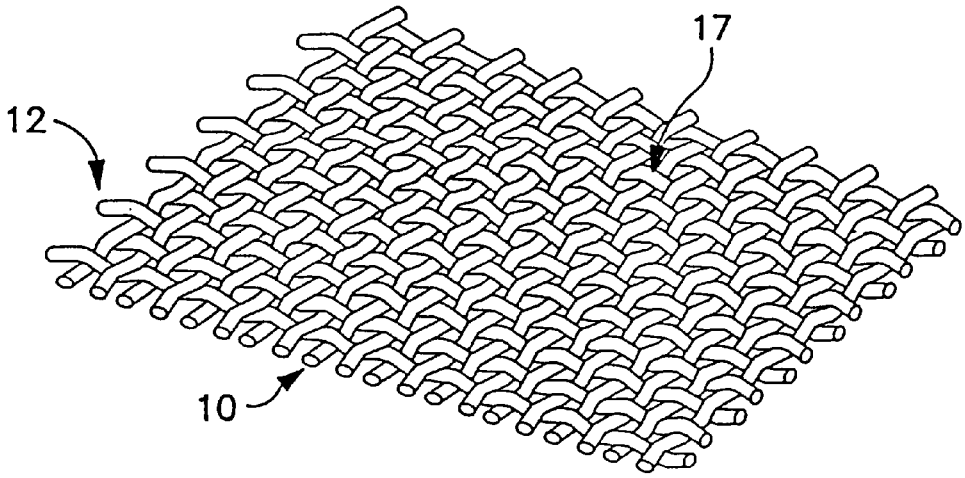
FIG. 2 is a perspective view of the open-weave fabric depicted in FIG. 1, with an additional coating shown in dots.
Figure 3:
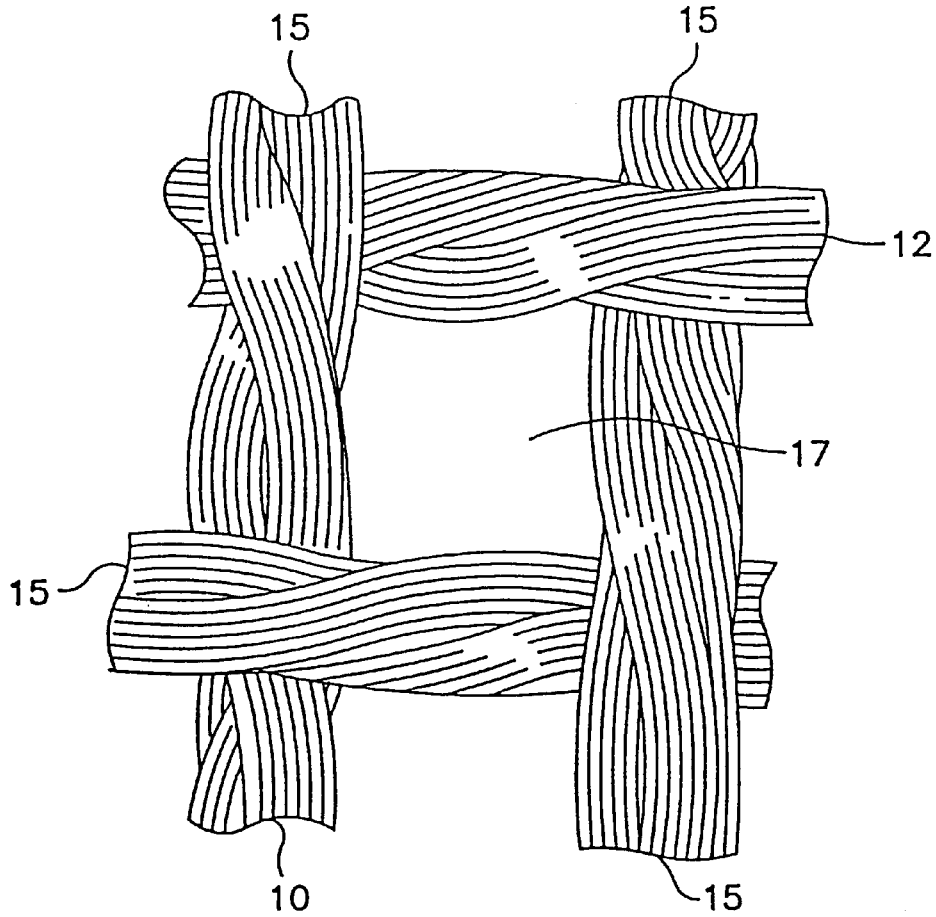
FIG. 3 is a magnified top-view of the open-weave fabric of FIG. 1, illustrating a preferred weave and also illustrating the construction of the warp and fill yarns.

Referring to FIGS. 2 and 3, the warp yarns 10 and fill yarns 12 are interwoven in a cross-over pattern. Each yarn is composed of a multiplicity of fine filaments 15 that are plied together into twisted bundles. The circular cross-sectional diameters of the warp and fill yarns prior to weaving is approximately 28 mils (1 mil=$1\times10^{-3}$ inch) for a particular application involving the diffusion of air from a conventional air duct. However, the diameters may vary depending upon various factors, including the type of fluid being dispersed, the fluid flow rate, the desired end deflection pattern, and other geometrical aspects of the web (such as the percentage open area, discussed below). After weaving, the cross-sectional shape of the yarn is elliptical.

The fabric sheet has a somewhat open weave 17. Each opening is essentially rectangular in plan, and is approximately 50×50 mils. In this embodiment, the total open area comprises approximately 38% of the area of the fabric. The thickness of the fabric sheet is approximately 23 mils. The dimensions of the open weave and percent open area are operable for a particular application involving air volumes and pressures associated with conventional air-handling systems. The dimensions of the fabric sheet may vary, however, depending on the volume and pressure of the air flowing into the fabric and the amount of deflection desired.

Figure 4:
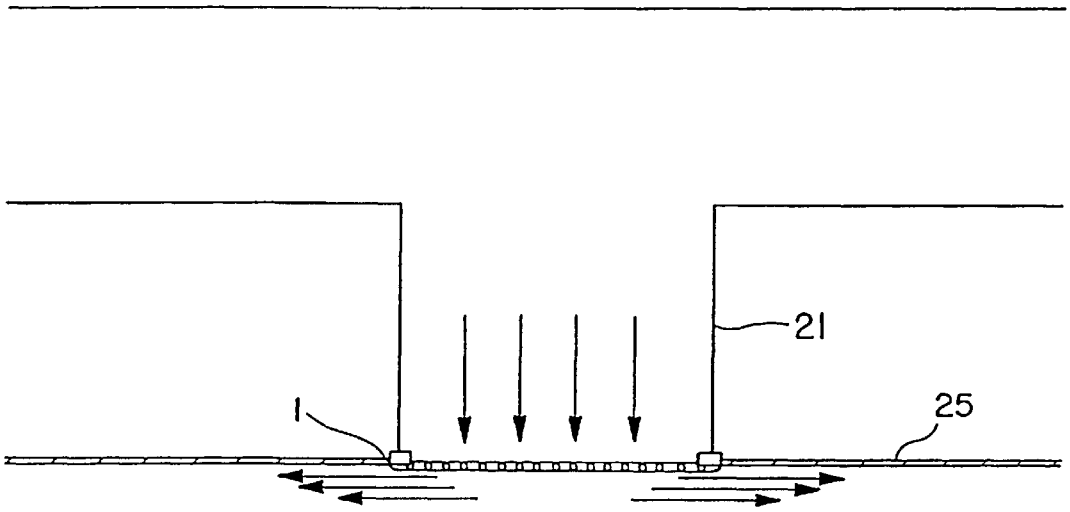
FIG. 4 is a side view of the diffuser of FIG. 1 mounted on the end of an air supply duct.
Figure 5:
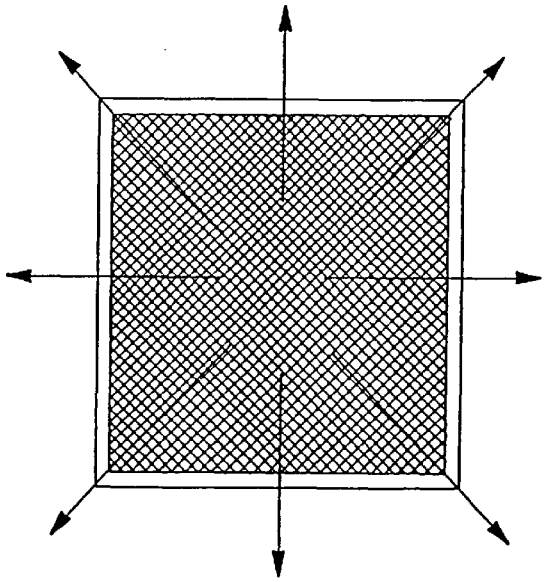
FIG. 5 is a bottom view of the diffuser mounted on an air supply duct as shown in FIG. 4.

Referring now to FIG. 4, the fabric air diffuser 1 is connected to the end of a tapered air supply duct 21, which is usually flush with the surface of the ceiling 25 in a room. The diffuser 1 is oriented on the end of the air supply duct 21 so that air from the duct flows into the fabric sheet. In FIGS. 4 and 5, the general direction of air flow propagation is denoted by arrows. While a number a factors, such as back pressure caused by the diffuser and the shape of the particular air duct, may cause a variation in the direction of air flow at any one given point within the duct 21, the general direction of air propagation is downwardly into the diffuser sheet (as denoted by the arrows above the diffuser). The fabric sheet changes the direction of air propagation as the air exits the sheet. The redirected air flows laterally to the sheet, as shown by the arrows in FIG. 4, and flows radially outward in all directions away from the sheet, as shown by the arrows in FIG. 5 (a bottom view). This redirection causes the air to hug the ceiling or wall depending on the placement of the particular diffuser and supply duct. While in the preferred embodiment, the air exiting the openings flows laterally to the fabric web and radially outward, it is envisioned that webs of varying types and dimensions based upon other materials may be employed to deflect air in other patterns. Also, while in the preferred embodiment the fabric sheet is an essentially planar configuration, it is envisioned that the sheet may be employed in a nonplanar formation, for example, by thermoforming it into a dish-shaped configuration.

Figure 6A:
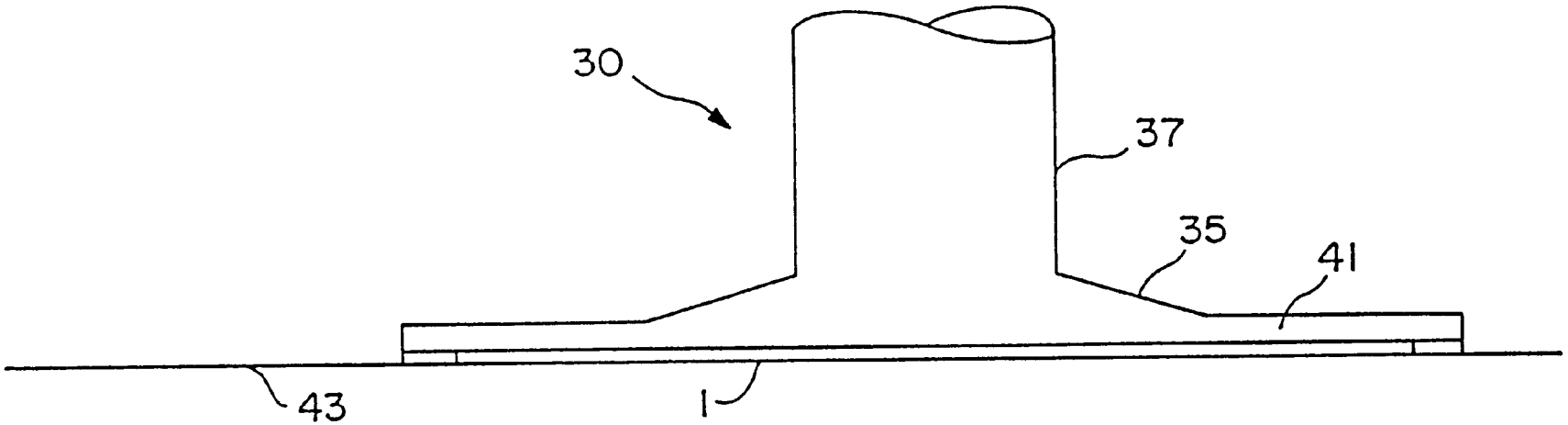
FIGS. 6A and 6B show side and top perspective views, respectively, of an air duct having a tapered portion extending into a rectangular cavity (known as a backpan).
Figure 6B:
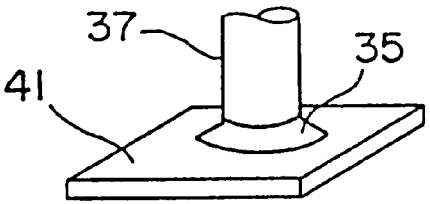

The air diffuser of the invention has been used successfully to redirect air propagation from air ducts of a number of different shapes and sizes. For example, FIGS. 6A and 6B show a duct 30 having a cylindrical air supply way 37 extending into a tapered portion 35 which further extends into an open-face rectangular cavity 41, known as a backpan. The backpan rectangular cavity 41 is disposed flush over a cut-away portion in the ceiling 43. The diffuser 1 is mounted over the open face of the backpan 41. Typical dimensions for the duct include a 6–12" diameter cylindrical supply way 37 extending into a backpan having equal side lengths of 21" and a height of 0.5". Upon testing, it was found that as air passed through the diffuser 1, the air flowed laterally from the diffuser and radially outward in all directions, as shown in FIGS. 4 and 5 above, respectively.

Figure 7:
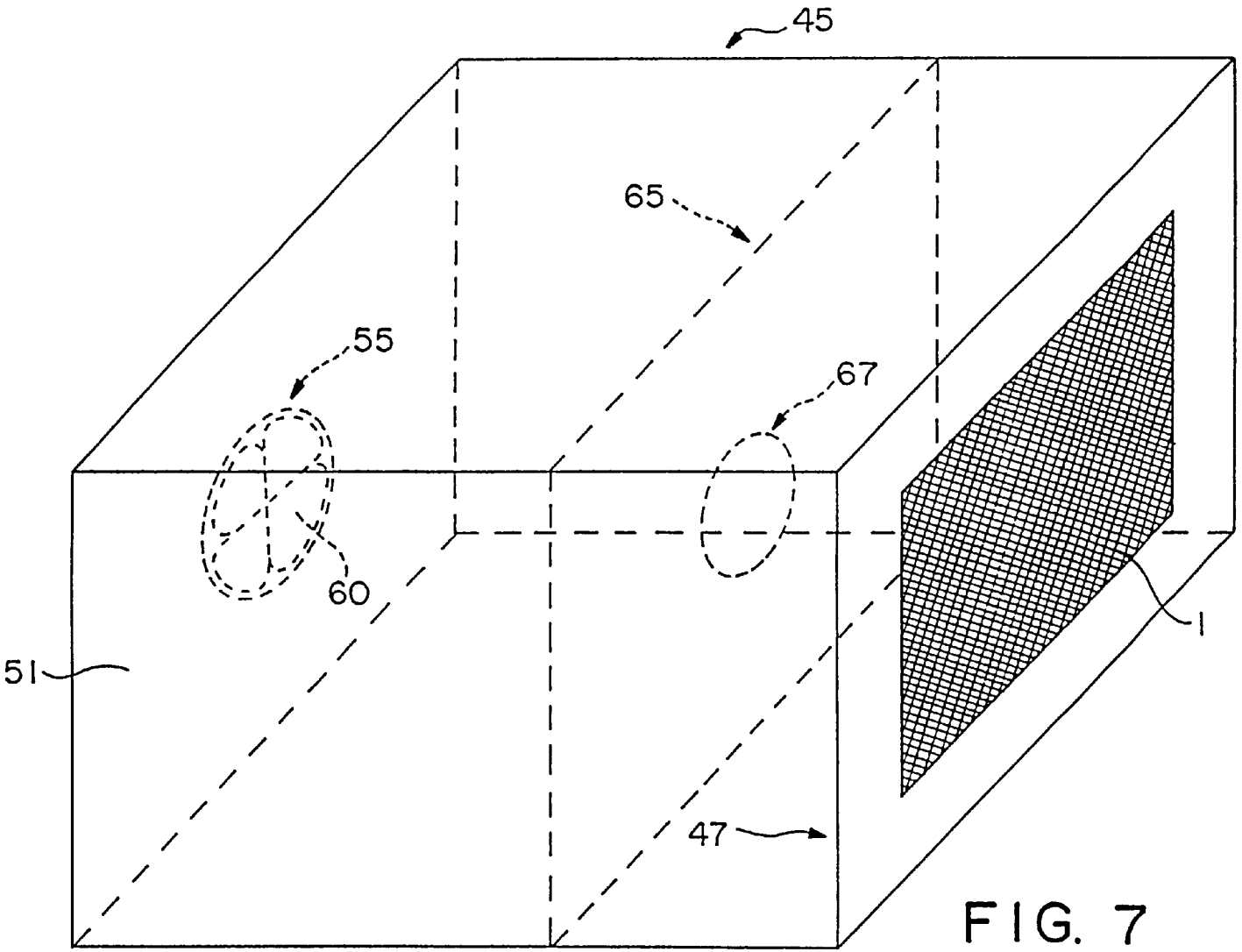
FIG. 7 shows a perspective view of an experimental air duct system.

The air diffuser has also been tested in an experimental duct system shown in FIG. 7. In the experiment, a rectangular box 45 having a length of 17", height of 10.5", and depth of 12.75" was made with an open end 47 and closed end 51 having a circular opening 55 approximately 4" in diameter. The diffuser 1 (constructed with the appropriate dimensions) was mounted over the open end 47, and a 4" fan 60 was mounted in circular opening 55. The baffle 65 having a 3" circular opening 67 was disposed across the center of the box 45. The baffle 60 used to create a variation in the pressure distribution of air on the interior of the box 45. At a number of different fan speeds, it was observed that air exiting the diffuser 1 would flow laterally to the diffuser and radially outward as it exited the diffuser 1.

It is also possible to control the radial pattern of thrown fluid (eg, air) to make it non-uniform in directionality while still essentially radial and laterally outward from the diffusing web. This may be achieved in a number of ways, for example by angling the feed duct with respect to the backpan (as shown in FIGS. 8C, 8D, 9A and 9B), or by blocking the flow through a prescribed portion (area) of the diffusing web, as shown in FIGS. 9C and 9D.

Figure 8A:
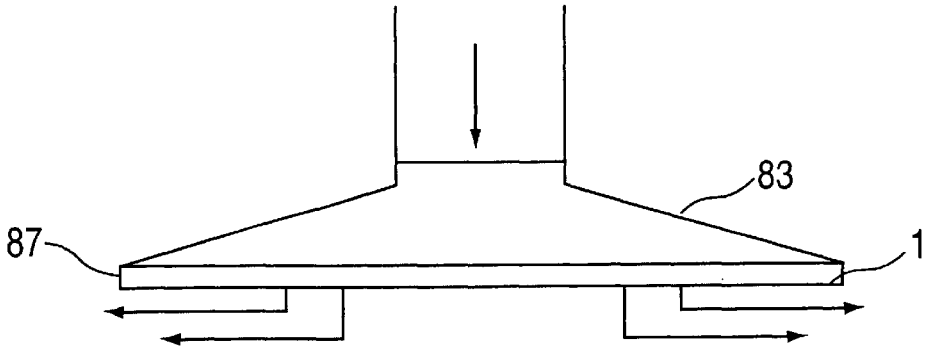
FIG. 8A shows a side view of the diffuser of the invention mounted at the end of an air supply duct, where the duct supplying the diffuser is essentially normal with respect to the diffuser face.
Figure 8B:
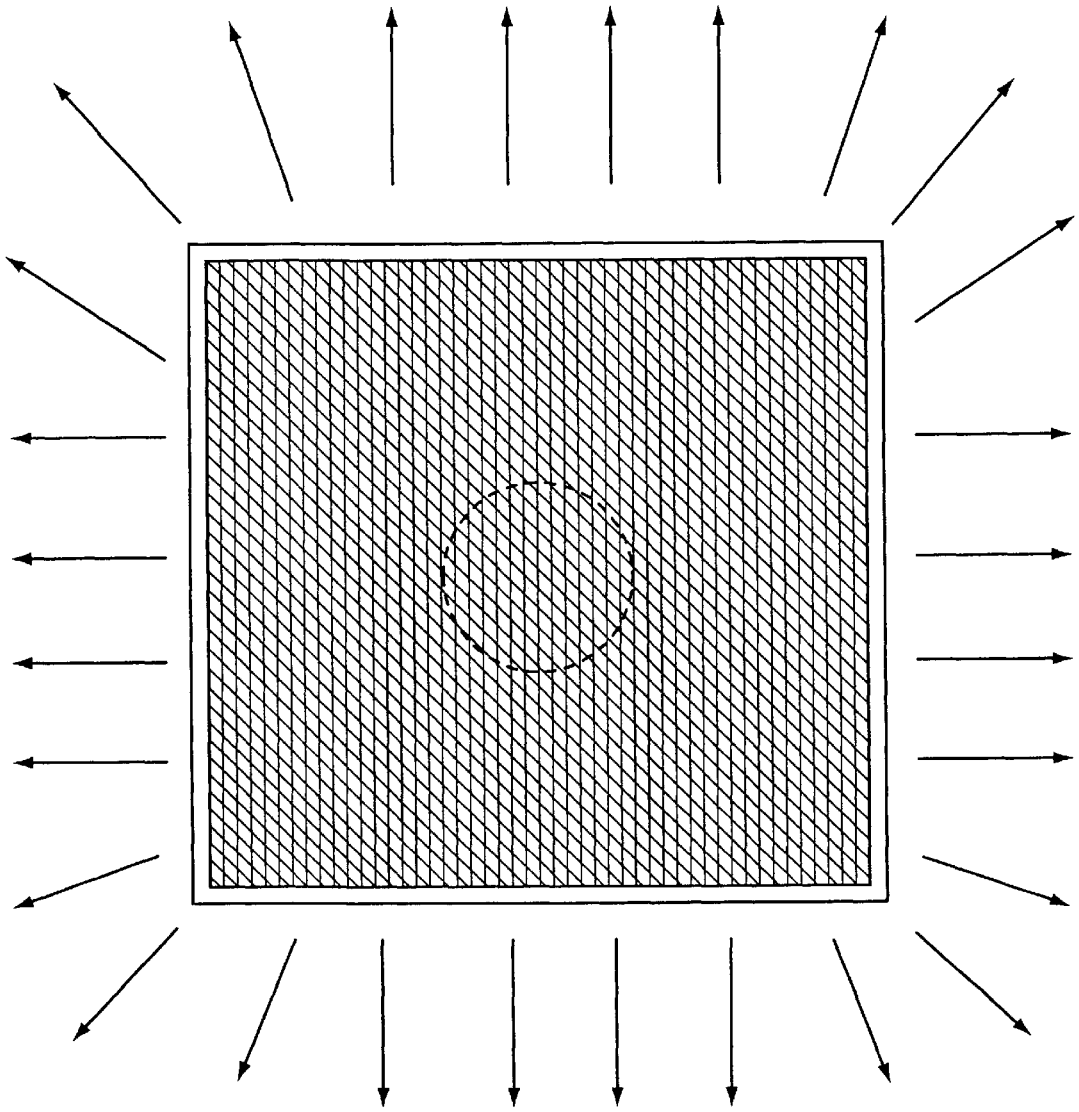
FIG. 8B shows the bottom view of the diffuser of FIG. 8A.
Figure 8C:
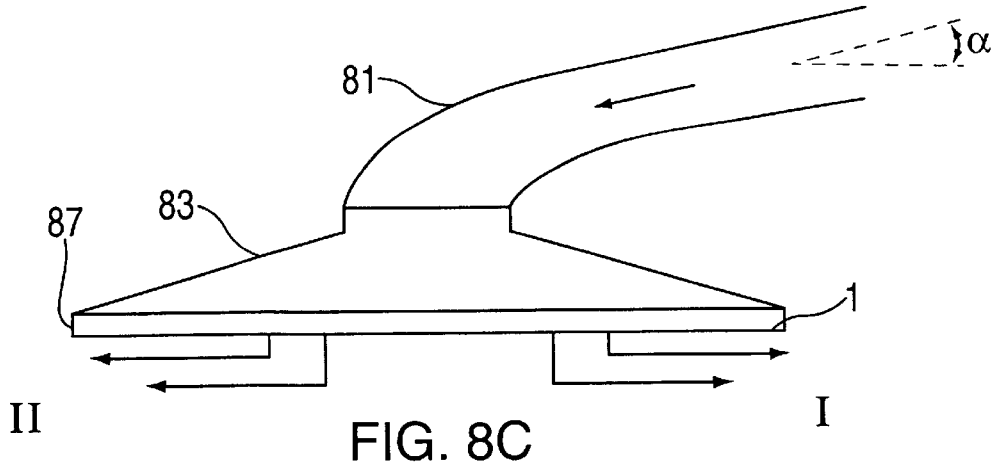
FIG. 8C shows a side view of the diffuser of the invention mounted at the end of an air supply duct, where the duct supplying the diffuser is at an angle with respect to the diffuser face.
Figure 8D:
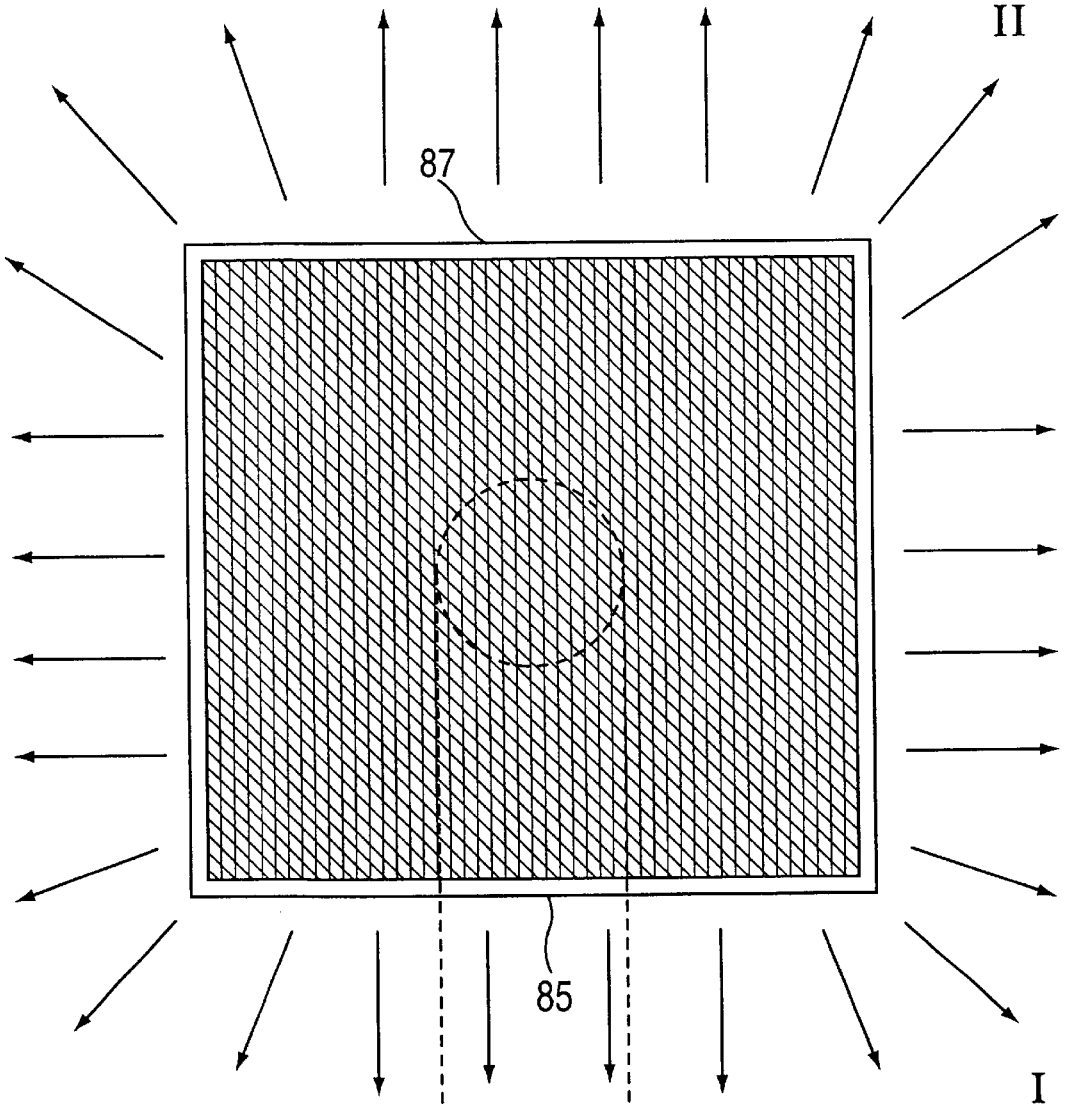
FIG. 8D shows a bottom line view of the diffuser of FIG. 8C.

In the embodiment shown in FIGS. 8C and 8D, an air supply duct 81 formed from a flexible hose approximately 10" in diameter, which is connected to the input of a backpan cavity 83. The flexible hose supply duct 81 is generally oriented at an acute angle a: relative to the plane of diffuser web 1. Referring to FIG. 8C and 8D, the angled orientation of the flexible hose supply duct 81 relative to the diffuser web 1 has the effect of increasing the volume and velocity of air exiting the web into Region II while decreasing the volume and velocity of air exiting the web into Region I. More particularly, it has been determined that the volume and velocity of air exiting the web is minimized in the area outside of edge 85 in Region I and increases across the diffuser to a maximum in the area outside of edge 87 in Region II. This dispersion pattern is quite distinct from the uniform radially dispersed pattern that is seen when the supply duct is oriented normal to the plane of the diffusing web. (See FIGS. 8A and 8B).

Figure 9A:
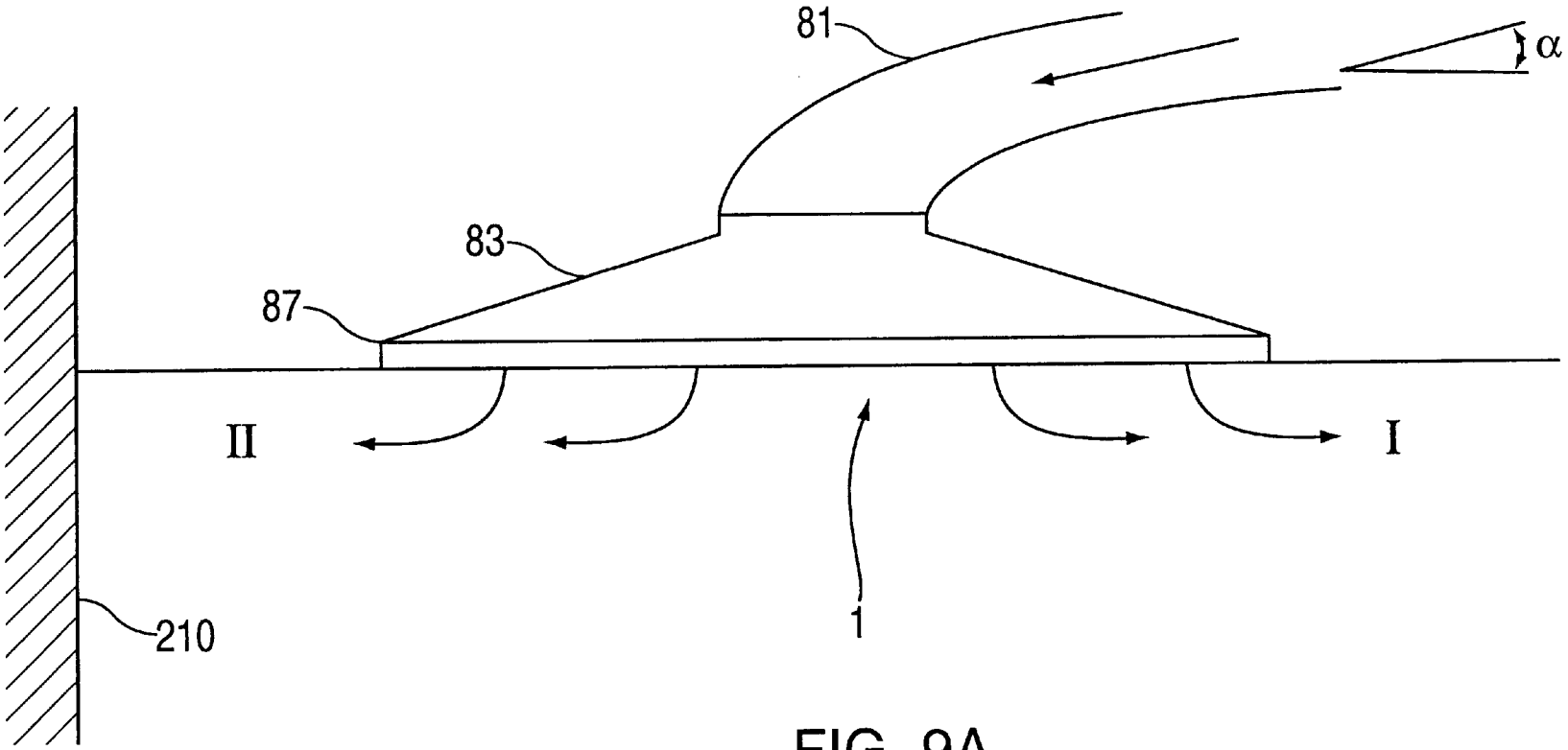
FIG. 9A shows a side view of a diffuser according to the invention mounted at the end of an air supply duct, where the duct supplying the diffuser is at an angle with respect to the diffuser face and the diffuser is disposed near a wall.
Figure 9B:
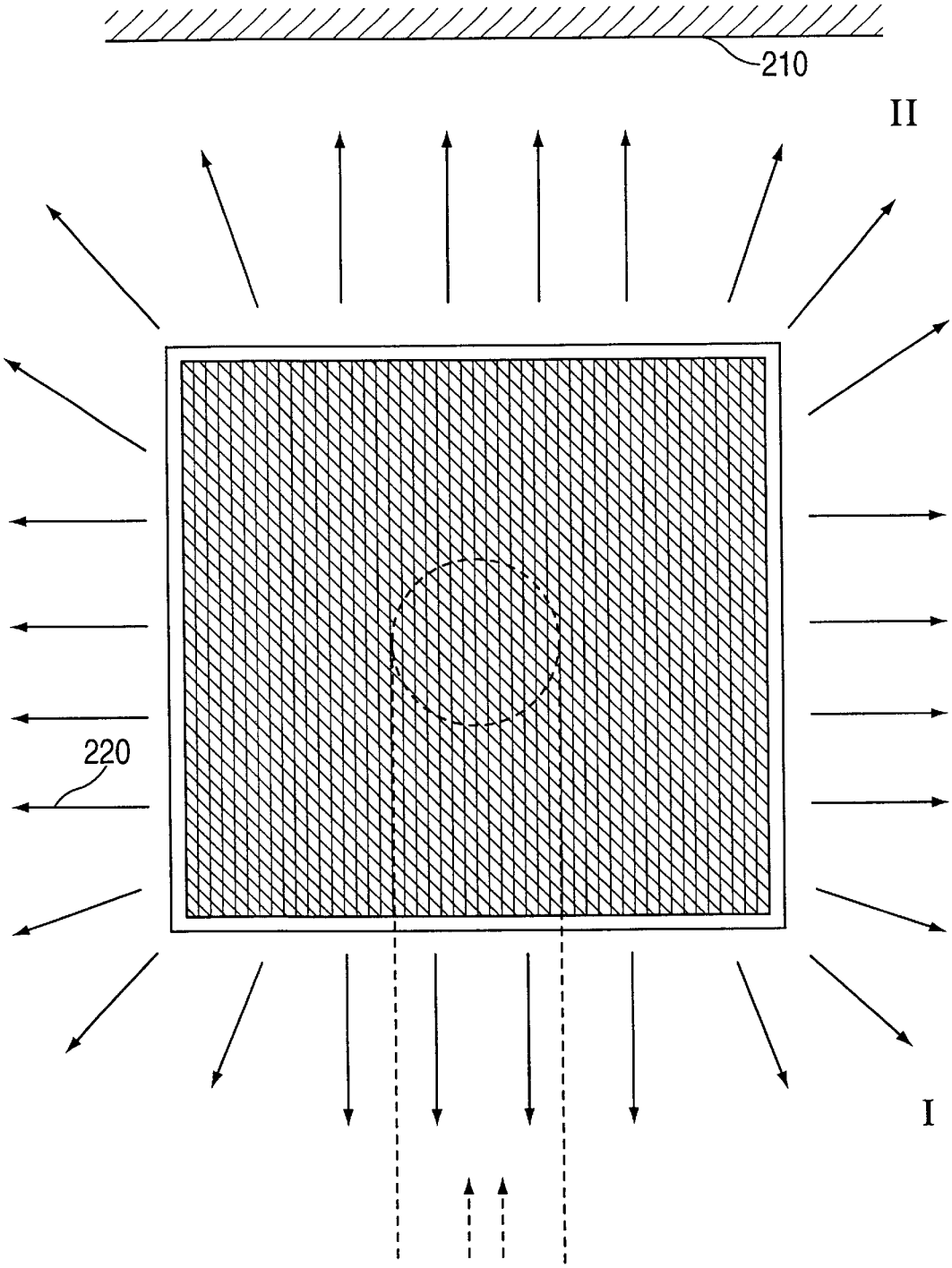
FIG. 9B shows a bottom view of the diffuser of FIG. 9A, and shows the air exiting the diffuser radially at different velocities around the diffuser.

FIGS. 9A and 9B further exemplify the phenomenon described above in connection with an embodiment of the invention where a flexible-hose supply duct 81 oriented at angle relative to the plane of the web 1 feeds a backpan 83 and diffuser web 1, which is disposed adjacent to a wall 210. As shown in FIG. 9B, due to the angled orientation of the supply duct, the volume and velocity of air exiting the diffuser 1 is higher in Region II than it is in Region I. In particular, the velocity of the air exiting the diffuser increases from 170–270 fpm in Region I up to 360–660 fpm in Region II.

Figure 9C:
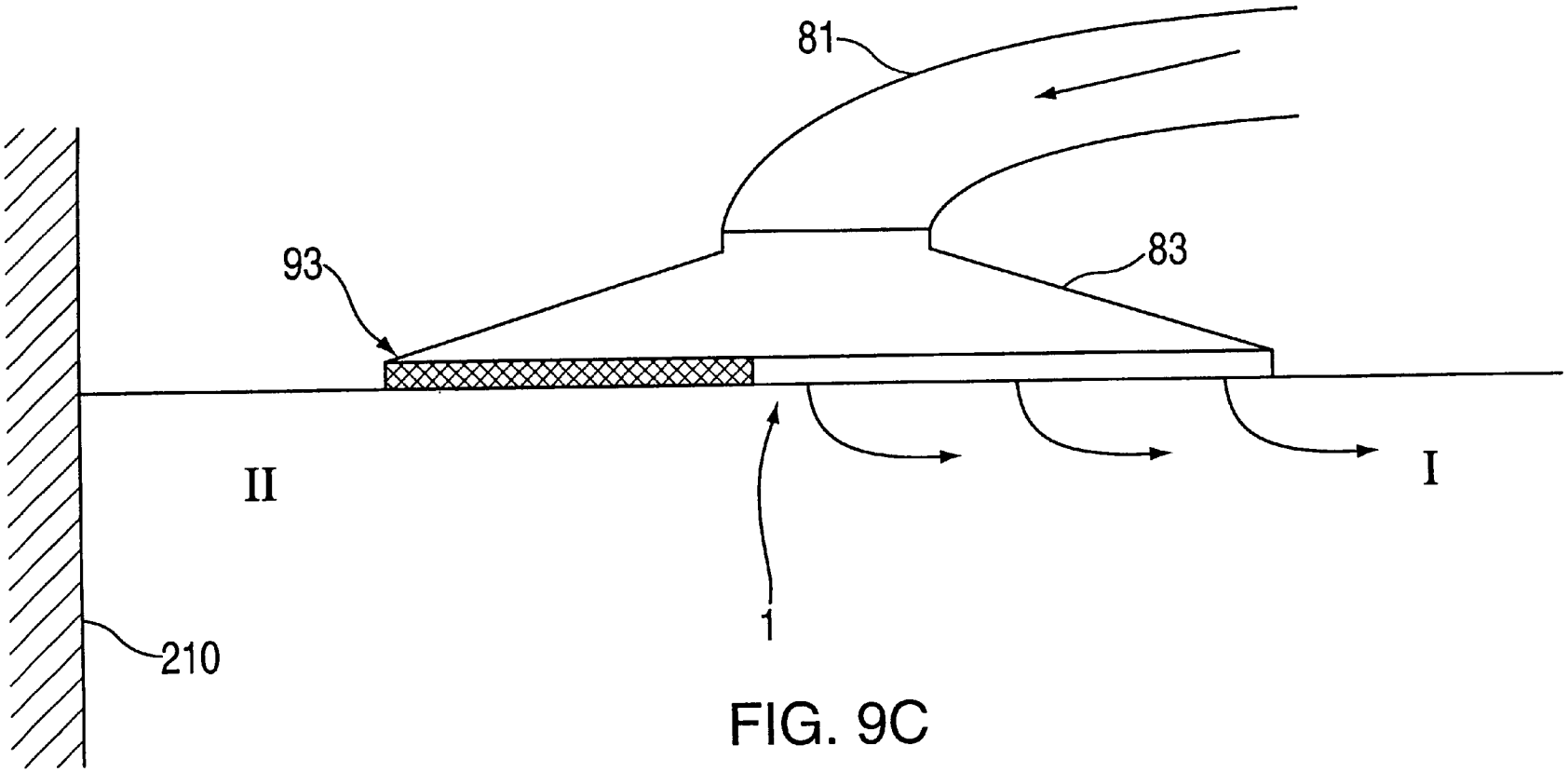
FIG. 9C shows a side view of a diffuser according to the invention mounted at the end of an air supply duct and containing an insert partially blocking the flow of fluid through the diffuser.
Figure 9D:
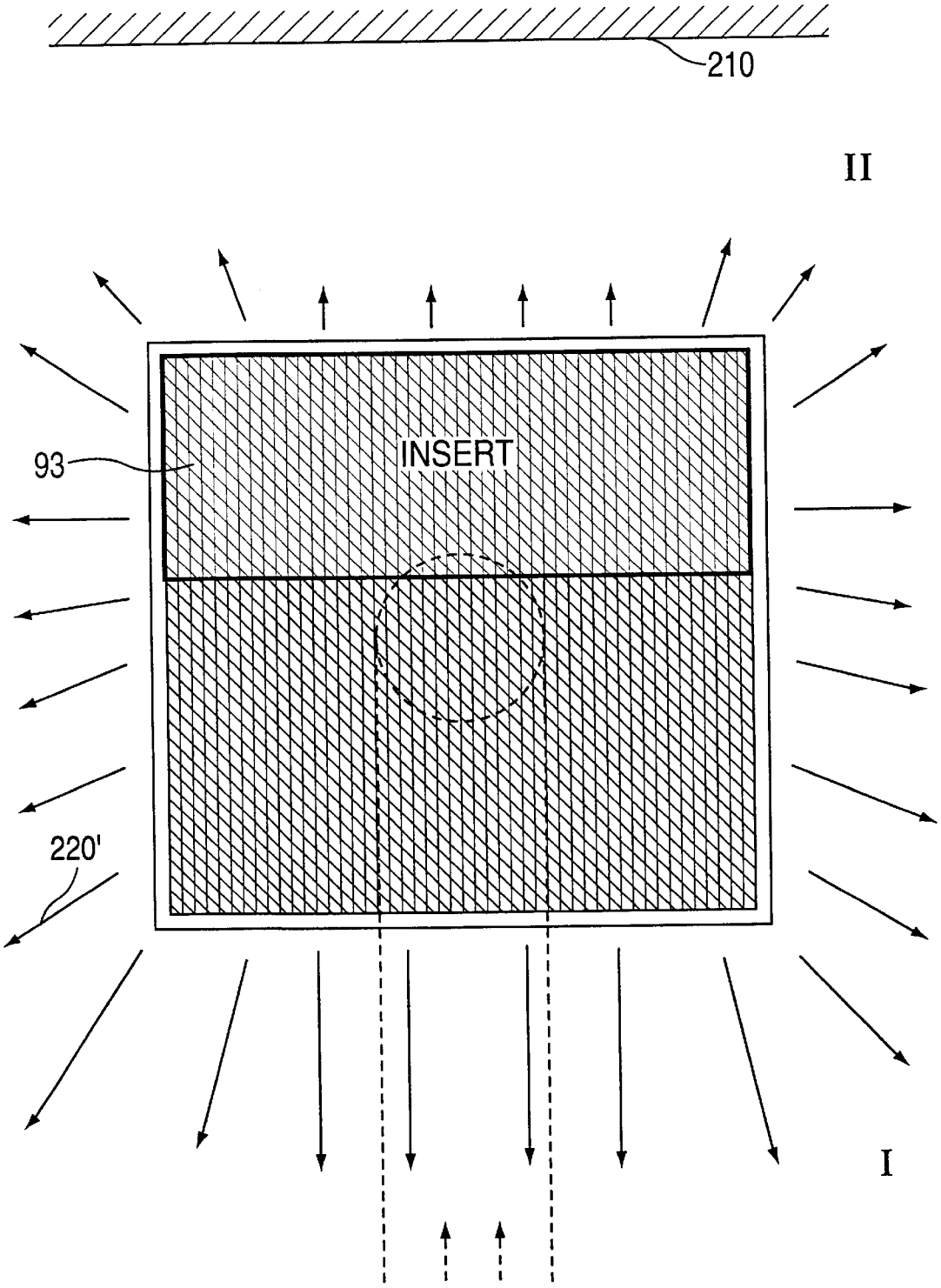
FIG. 9D shows a bottom view of the partially blocked diffuser of FIG. 9C.

FIGS. 9C and 9D show an embodiment wherein an insert 93 is placed within a portion of the diffuser to counteract the increase in velocity of air resulting from the angled orientation of the flexible-hose supply duct 81 relative to the diffuser 1. Because the insert 93 blocks a portion of the diffuser web 1, the air passing through the diffusing web must travel through a reduced area, and therefore must flow through the web at a higher velocity, and at a different angle of entry, depending upon the location of the blocked area. Blocking off a portion of the diffusing web therefore can change the radial distribution of airflow exiting the diffuser. For example, in FIGS. 9C and 9D, the insert 93 has the effect of redistributing air to increase air flowing from the diffuser in Region I (up to speeds of 370–580 fpm), while decreasing the flow of air from the diffuser into Region II (down to speeds of less than 40 fpm). This is highly desirable for diffusers located, eg., in a ceiling in a corner of a room to throw air further into the room as opposed to a radially uniform throw. The pattern of such "blocked portions" may be selected to create any given radially non-uniform flow pattern, and such blockages may be allowed to remain constant over time or to change their pattern over time through simple means; e.g., a film/foil/or sheet with a given pattern of perforations may be mounted between the diffuser web and the fluid supply duct or plenum (backpan) so as to prevent flow through portions of the diffuser itself. Or, a fluid blocking device may be allowed to change over time through, e.g., motorized shafts, controlling their rotation in the plane of the diffuser itself.

Desirable patterns of perforation in the fluid diffusion web might include round holes or varying diameter, spiral slots, or other discrete or continuous shapes to achieve a desired spatial distribution of fluid exiting the diffuser web. A plurality of molded diffusion webs sheet arranged in series above each other may also be employed to alter the pattern of fluid flow.

It is important to note that the use of such blocking sheets as described above does not affect the ratio of open area to gauge of the actual diffusing web itself, thus it may be geometrically optimized independently of the employment of "blocking sheets," a feature of importance to both proven design and use.

Figure 10:
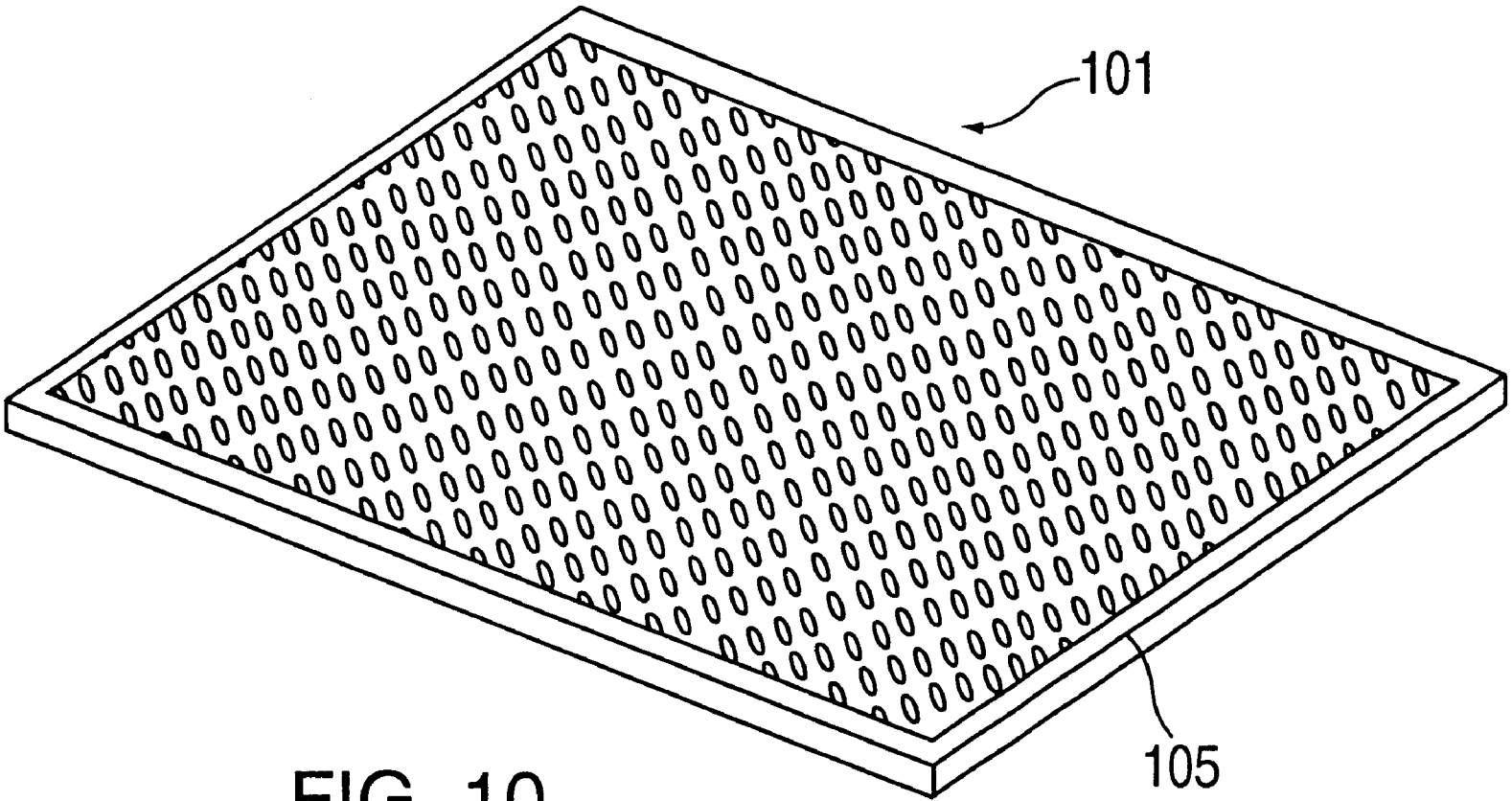
FIG. 10 is a perspective view of a second embodiment of the invention where the pore-containing web is composed of a molded polymer material.

Referring to FIG. 10, in a second embodiment of the invention, a pore-containing web is constructed from a molded plastic web diffuser 101. In this embodiment, the molded web diffuser 101 is mounted with a rectangular frame 105 adapted to be connected to the end of a typical air supply duct. Although the molded web diffuser shown in FIG. 10 is rectangular in shape, the molded web diffuser can be of any shape, including square, triangular, octagonal, circular, elliptical, etc. In a preferred embodiment, the molded web diffuser 101 is a flat, thin molded polymer sheet having a plurality of elliptical holes. The molded web diffuser 101 may be constructed from a variety of polymers and other materials, such as elastomers, fluoroplastics, fluoroelastomers, polyester, PVC, polyethylene, polypropylene, PEEK, PEKK, acrylic polymers, polystyrene, ABS, PPS, metals or blends thereof In addition, antistatic compounds as are known in the plastics art may be incorporated in the polymeric composition of the plastic molded diffusing web so as to prevent dust or particle buildup on the top side of the web and maintain an open area for the air flow to pass through. The molded plastic web can be mounted in the frame. Alternatively, the plastic web and frame assembly can be molded as one monolithic unit. This molding step can be achieved by heating and compressing the thermoplastic assembly.

The frame and/or the web can be reinforced by fibers known to be suitable for stabilizing thermoplastic materials. For example, the use of carbon fiber or glass fiber technology offers a simple way to integrate light-weight fiber as reinforcement for the molded diffuser web frame assembly.

The frame and/or the web can also be filled with reinforcing or non-reinforcing fillers for achieving reduced weight and/or cost. Conventional thermoplastic fillers which could be used include glass spheres, silica particles, mica, calcium carbonate, carbon black, china clay, or talc. The frame and/or web may also be filled with magnetically active particles, allowing the frame and/or web to function as a filter for magnetically active fine particles contained in the diffused fluid. Ultraviolet (UV) light stablizers and antioxidants may also be incorporated into the frame and/or web.

The molded web may also be coated by soil-resistant material, provided a substantial open area is maintained in the sheet. The soil-resistant material is preferably a fluoropolymer, such as polytetrafluoroethylene (PTFE), although other low surface energy polymers, such as fluoropolymers, may be employed. Such fluoropolymers include FEP, PVDF, PFA, THV, PCTFE, FKM and FFKM.

The troublesome effects of static charging is a surface phenomenon. Chemical additives such as antistatic reagents ("antistats") can remedy the static buildup. External antistats, such as glycerine or polyglycols, can be applied to the surface of the molded plastic web usually by spraying or by dipping the web or web-frame assembly into a dilute (0.1% to 2.0%) solution of the antistatic in water or alcohol. A more permanent antistatic protection is effected by incorporating antistat into the surface layer of the molded plastic at 1–2%. Chemical antistats are usually also surfactants, which may be cationic, anionic or non-ionic compounds, as known in the art. Non-ionic antistats are preferred in the inventive embodiments as they have low polarity which aids in their compatibility with plastics such as olefins and others. Moreover, non-ionic antistats are not irritating when released in the air. Non-ionic internal antistats range from 0.05 to 2.5% which range is suitable for polypropylene, provided the molding temperature do not exceed the stability of the antistatic compound such as the preferred ethoxylated tertiary amine which is particularly efficient in low humidity environments.

Forming the thermoplastic composites, reinforced or plain, into diffusing webs involves a stamping or compression molding operation. Subsequent treatment of the molded web may include dipping the web into, or spraying the web with, a solution, dispersion, or pure component of any of the surface treatments and coatings discussed above.

Figure 11:
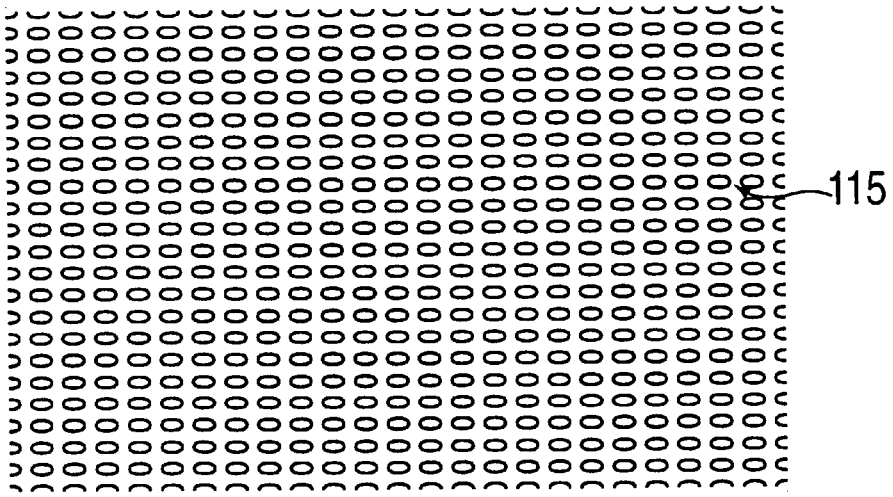
FIG. 11 is a top-view of the molded polymer web used in the present invention.

Referring to FIG. 11, the molded plastic ribs are aligned in a cross-over pattern. Each perforation is formed by fine ribbing 115. The preferred plastic is polypropylene. Other materials that may be used to construct the molded web include thermoplastic and thermoset polymers, elastomeric and elastoplastic polymers, fluoroplastics, fluoroelastomers, polyester, PVC, polyethylene, polypropylene, PEEK, PEKK, acrylic polymers, polystyrene, ABS, PPS, polyaramid, fibrillated PTFE and metals or blends thereof The thickness of the molded web is approximately 0.030 inches, preferably 0.026 inches, or more preferably 0.020 inches. After compression, the cross-sectional shape of the perforation is oval. The size of the perforation may range from 0.085 to 0.0170 inches depending on the web thickness. The perforations are preferably in-plane with the surface of the web.

Figure 12:
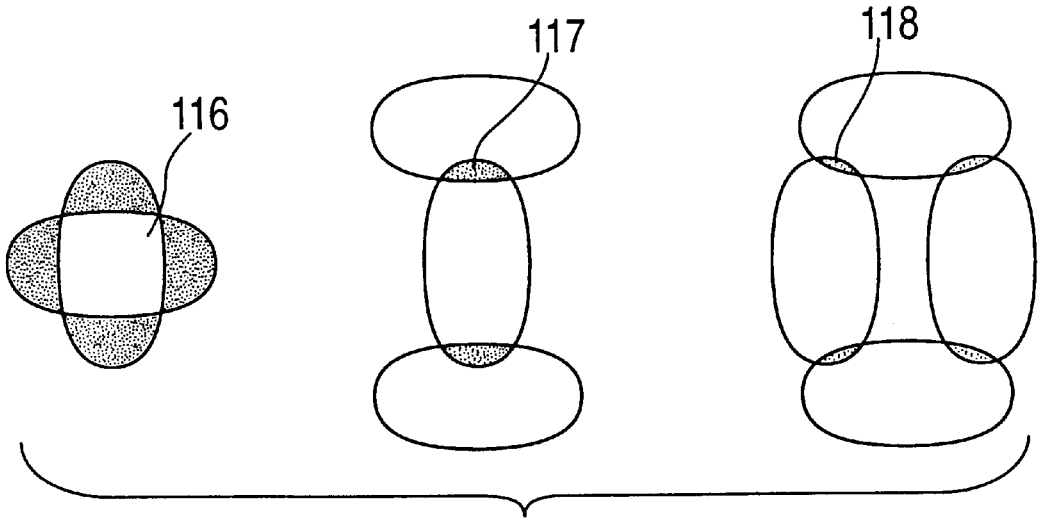
FIG. 12 is a magnified top-view of the three preferred open configurations illustrating a preferred 2-ply molded plastic web assembly wherein two webs are superimposed at a 90° rotation.

Another embodiment of the molded plastic web diffuser of the invention is a 2-ply web frame assembly wherein the webs are either superimposed at the same alignment or superimposed after a 90° rotation with respect to each other. FIG. 12 illustrates the three main shapes formed by the superimposed perforations. The overlapping areas 116–118 are shown. The perforation of the superimposed webs can be of equal or different size. If different, the larger perforation is preferably placed above the smaller one.

The molded web has openings which are essentially rectangular or oval in plan. The total open area can range approximately from 30 to 60% of the area of the web. The openings are preferably in-plane with the surface of the web. The dimensions given for the molded web are operable for air volumes and pressures associated with conventional air-handling systems. The dimensions of the web may vary, however, depending on the volume and pressure of the air flowing into the fabric and the amount of deflection desired.

In addition to diffusion of air, many other end uses are contemplated by the present invention. For example, the diffusing web may be used as a device to mix fluids in a vessel without the need to employ moving parts. Also, the diffusing web can be used in dryers to "sweep" away vapors in a lateral flow for recovery and recycling. Alternatively, the diffusing web can be used in dryers to minimize the potential for "uneven" drying induced defects, which are particularly prone to occur during drying of coatings and castings.

The diffusing web can be used in flood controls and gates as a means for controlling downstream erosion. The diffusing web will dissipate forces normally going downstream which reduces erosion downstream.

The diffusing web can be used to control the flow of fluids which flow from unenclosed spaces. For example, the diffusing web can be used to redirect the direction wind passing through the web. One embodiment of this application would be for use as a "screening type" material on a window (for example, in a porthole on a ship), where the diffusing web would allow air to pass through, while protecting the occupants from the room from strong drafts.

The diffusing web of the present invention can also be used in various geometric arrangements, such as static or dynamic pleated or conical arrangements. These arrangements may be used to dissipate undesirable velocity vectors in certain applications.

It is contemplated that the diffusing web of the present invention may also include a means for heating the fluid (such as air) as it passes through the diffusing web.

The diffusing web can also be used to distribute airflow out of ducts designed to project air onto glass surfaces for means of heat transfer or defogging, such as at the end of an automobile's defrosting/defogging system.

The diffusing web can also be used in applications such as an air return opening, connecting the occupied space with the return plenum of an air handling system.

The diffusing web can also be used as a mist separator, or a fine particle separator, for fluids containing mists or fine particles. It may also be used to separate components of a suspended or emulsified system.

The diffusing web may additionally function to heat fluid as the fluid passes through the web. This can be accomplished by incorporating within the web a material capable of generating heat under applied electric current. Alternatively, a material capable of generating heat under applied electric current may be disposed in proximity to the web.

EXAMPLE 1

A sheet of Chemglas® 1589, PTFE-coated glass fabric, manufactured by Chemfab Corporation, Merrimack, N.H., approximately 23 inches square was mounted within a rectangular frame adapted for connection to the end of an air supply duct. The sheet had the same dimensions as given in the above description and was mounted such that the warp and fill yarns extended diagonally across the rectangular frame.

The diffuser was then mounted to an angled backpan the end of an air supply duct which was flush with the ceiling surface. The redirection and speed of the flow of air was then observed. The air stream flowing into the backpan abruptly changed directions upon exiting the diffuser web, to flow laterally or relatively parallel to the plane of the fabric.

Furthermore, as one traversed the plane of the fabric with an anemometer, a "dead zone," i.e., an area where the air velocity is below the 200 fpm sensitivity of the velometer used for velocity measurements, was found on the surface of the fabric in an area between the center area of the diffuser (below the feed area of the angled backpan) and the outer few inches of the diffuser face. Flowrates much higher than 200 fpm were observed in the center and near the edges of the diffuser face. Virtually no air flow was observed when the measuring device was located several inches below the diffuser. The horizontal component of air flow, that is, the throw, extended significantly beyond the fabric-covered opening away from the air flow source in all directions yet maintained its "ceiling hugging" characteristics.

It was further observed that the noise associated with the device as the air propagated through the fabric was much less noticeable than the noise associated with conventional diffusers.

EXAMPLE 2

Uncoated glass (G 150 4/3 yarn) was woven into a fabric with a count of 13×12 (warp×fill in yarns/inch) and a weight of 12.6 oz/yd. The fabric was then coated with PTFE, resulting in a coated fabric of 34% open area, a count of 13×12 (warp×fill), and weight of 13.6 oz/yd. The fabric was mounted within a rectangular frame adapted for connection to the end of an air supply duct to create a diffuser.

Referring to FIG. 9A, the diffuser 1 was mounted to a backpan 83 disposed in a ceiling about 3 feet away from a nearby wall 210. Air is supplied into the back by a flexible hose air supply duct 81 (approximately 10" in diameter), which is oriented at an angle to the plane of the diffuser 1. Angle was measured at about 35°. An Alnor AP150 baleometer was used to measure the air flow in standard cubic feet per minute (scfm). An Alnor AP150 unit with a model 275 hot-vane type anemometer probe was used to measure the airflow velocity in feet per minute (fpm). All velocities were measured 0.25" below the diffuser frame. Referring to FIGS. 9A and 9B, the total flowrate of air expelled from the diffuser was determined to be 470 scfm. This indicated that the flowrate in the flexible hose supply duct 81 was also 470 scfm. Measurements at point locations indicated that the velocities across the edge of the diffuser nearest the wall in Region II were between 360 and 660 fpm. The velocity values recorded along the diffuser edge farthest away from the wall in Region I were 170–270 fpm. The higher velocities in the near-wall edge are due to the duct supplying the diffuser being at an angle with respect to the diffuser face, and supplying more air to the near-wall side of the diffuser than to the far wall side. It was observed that adjusting the feed angle of the duct into the diffuser expelled air preferentially in one direction and expelled air less in the other directions. Where the feed angle of the duct is essentially normal to the diffuser, air flow is essentially uniform laterally and radially outward from the diffuser, as shown, for example, in FIGS. 8A and 8B.

EXAMPLE 3

The increased airflow towards one wall as described above in Example 2 can be problematic in some instances. A 9½ inch×23 inch insert was created from 2 mil (0.002 inch) thick PTFE film for the diffuser described above. The insert was placed on top of the fabric diffuser face, against the edge of the diffuser near the wall and aligned parallel to the wall 210, as shown in FIGS. 9C and 9D. The insert was held in place with tape for convenience, but tape was not necessary. Airflow measurements made on the diffuser with the insert indicated a flowrate out of the diffuser of 470 scfm, and measurements at point locations indicated that the velocities across the edge of the diffuser (¼ inch down from the diffuser face) nearest the wall in Region II were less than 40 fpm. The velocity values recorded along the diffuser edge farthest away from the wall in Region I (¼ inch down from the diffuser face) were 370–580 fpm. It was observed that the insert effectively blocked airflow in the direction of the wall, and caused higher velocities in the airflow away from the wall. Referring to FIG. 9D, arrows directed away from the wall 210 denote air velocity of 370–580 fpm, while arrows directed toward the wall 210 denote air velocity of less than 40 fpm.

Without the insert in place, as shown in FIGS. 9A and 9B, the air direction at position 220 in FIG. 9B travels essentially normally away from the edge of the diffuser and essentially parallel to the wall 210. However, with the insert in place as described above, shown in FIGS. 9C and 9D, the air direction in a corresponding position 220' in FIG. 9D is now at an angle away from the wall 210.

EXAMPLE 4

A molded plastic web diffuser was tested in three different configurations. The first web was of thickness of approximately 0.030 inches, the second approximately 0.026 inches, and the third approximately 0.020 inches. The axis approximate axial dimensions of the perforated openings for the three thicknesses tested were as follows:

about 0.165 to 0.170 inches along the major axis and about 0.110 to 0.118 inches and 0.120 inches along the minor axis at about 0.030 inches thickness; about 0.155 to 0.160 inches along the major axis and about 0.095 to 0.100 inches along the minor axis at about 0.026 inches thickness; and about 0.150 to 0.155 inches along the major axis and about 0.085 to 0.095 along the minor axis at about 0.020 inches thickness. In terms of open area, the calculated values were approximately 53%, 44% and 39% for the 0.030 inch, 0.026 inch and 0.020 inch thick webs, respectively.

An efficient deflection of the air flow through the molded web assembly was observed. Specifically, the 0.020 inch configuration was effective in deflecting an air flow of 650 cfin (cubic feet per minute). The larger perforations were also effective, depending on the air flow pressure or velocity.

EXAMPLE 5

Figure 13A:
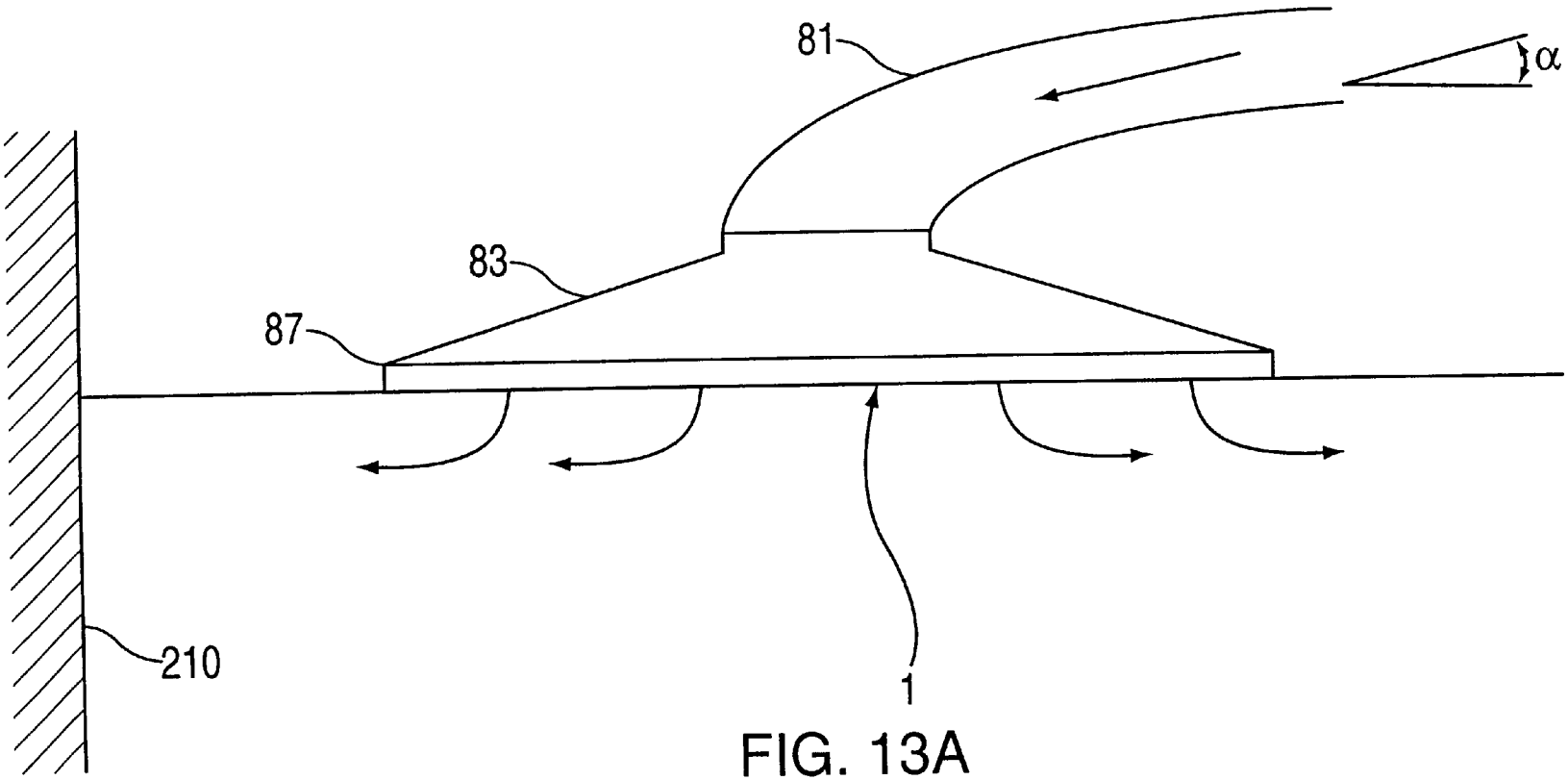
FIG. 13A shows a side view of a diffuser according to the invention mounted at the end of an air supply duct, where the duct supplying the diffuser is at an angle with respect to the diffuser face and the diffuser is disposed near a wall.
Figure 13B:
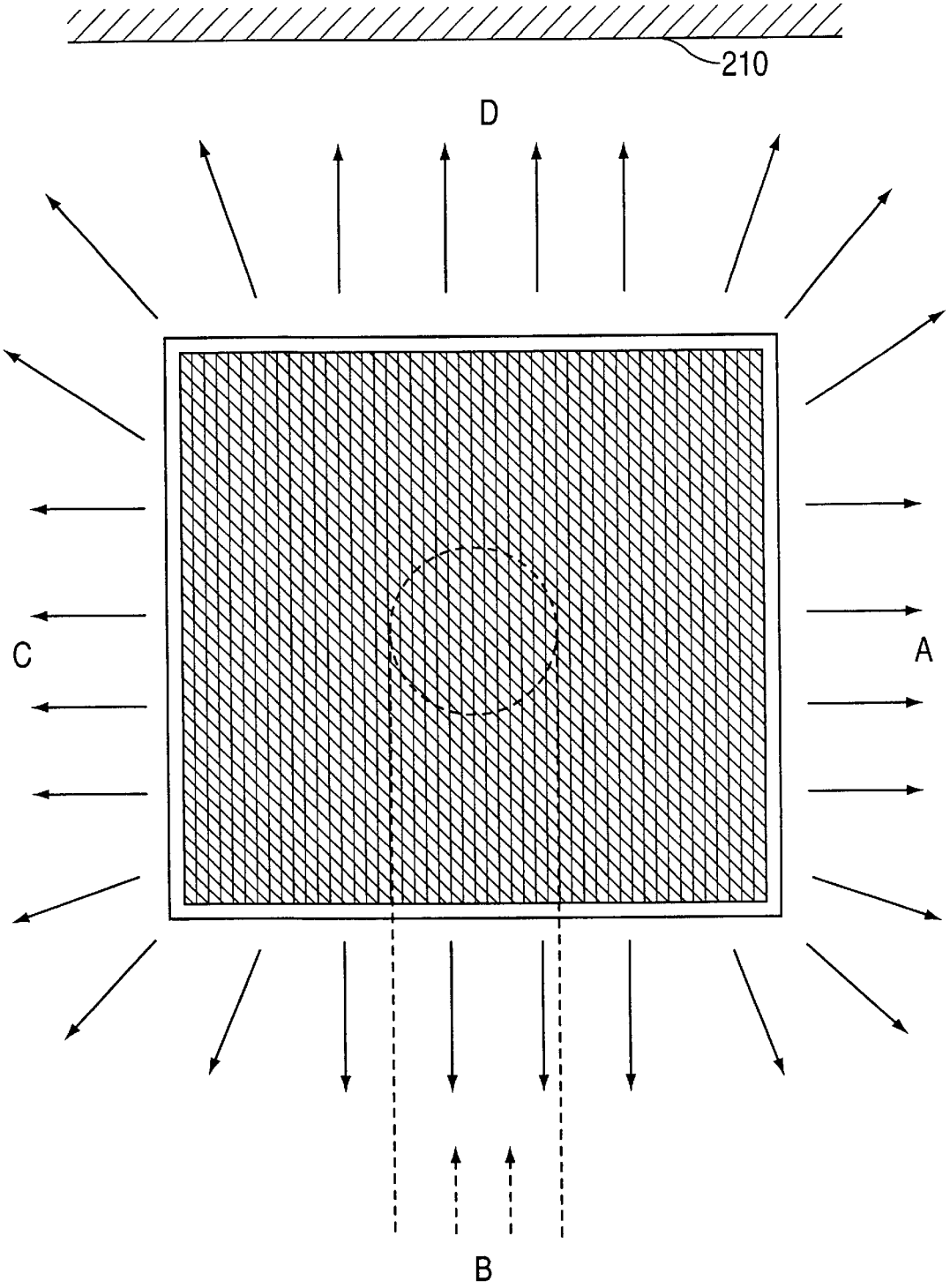
FIG. 13B shows the bottom view of the diffuser of FIG. 13A, and shows the air exiting the diffuser radially at different velocities around the diffuser.

The diffuser of Example 2 was mounted to the end of a conventional air supply duct, which was located in the ceiling 3 feet away from a nearby wall. The air duct supplied air at an angle to the diffuser by the means of a flexible hose approximately 10" in diameter attached to a backpan, as shown in FIG. 13A. Angle o was measured at about 35°. An Alnor AP150 baleometer was used to measure the air flow in standard cubic feet per minute (scfm). An Alnor AP150 unit with a model 275 hot-vane type anemometer probe was used to measure the airflow velocity in feet per minute (fpm). All velocity values were recorded 0.25" below the diffuser frame. The flowrate of air expelled from the diffuser was determined to be 460 scfm, and measurements at point locations indicated that the velocities across the edge of the diffuser nearest the wall (side D in FIG. 13B) averaged 600 fpm. The velocity values recorded along side A (FIG. 13B) averaged 400 fpm. The velocity values recorded along the diffuser edge farthest away from the wall (side B in FIG. 8D) averaged 200 fpm. The velocity values recorded along side C (FIG. 13B) averaged 450 fpm. The higher velocities at the near-wall edge are due to the duct supplying the diffuser being at an angle with respect to the diffuser face, and supplying more air to the near-wall side of the diffuser than to the far wall side.

Figure 14A:
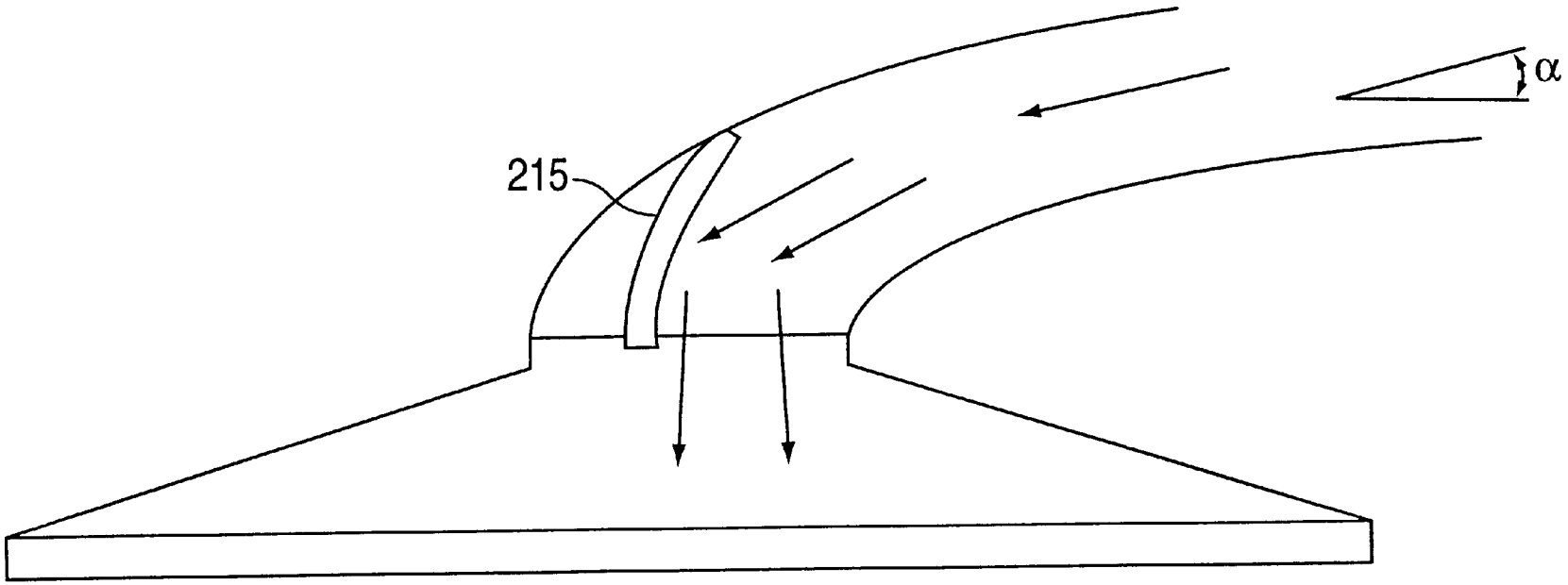
FIG. 14A shows a side view of a diffuser according to the invention mounted at the end of an air supply duct and containing a vane inserted at the end of the supply duct, above the diffusing web, to direct the angled airflow towards the center of the diffusing web, to produce more uniform radial distribution of the air by the diffusing web as compared to the distribution shown in FIG. 13B.
Figure 14B:
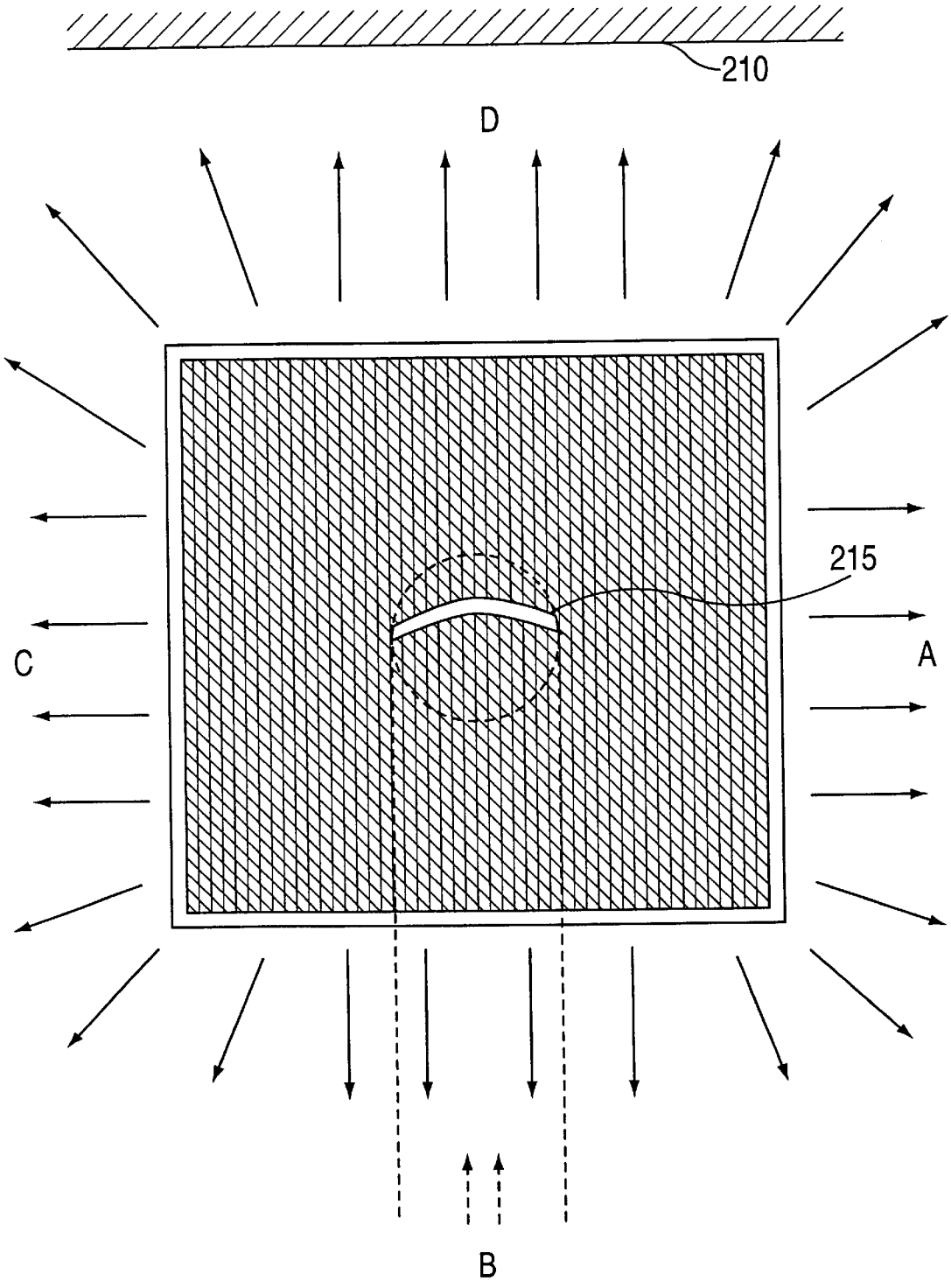
FIG. 14B shows a bottom view of the diffuser of FIG. 13A, and the more even radial distribution of airflow as compared to FIG. 13B.

A vane 215 produced from a piece of 25 mil (0.025") thick PTFE was cut and secured into the feed duct, at a diffuser entrance, as shown in FIGS. 14A and 14B. The airflow pattern generated by the diffuser was then measured. The flowrate of air expelled from the diffuser was determined to be 425 scfm, and measurements at point locations indicated that the velocities across the edge of the diffuser nearest the wall (side D in FIG. 14B) averaged 300 fpm. The velocity values recorded along side A (FIG. 14B) averaged 300 fpm. The velocity values recorded along the diffuser edge farthest away from the wall (side B FIG. 14B) averaged 450 fpm. The velocity values recorded along side C (FIG. 14B) averaged 500 fpm.

It was observed that the inserted vane effectively redirected the air flow entering the diffusing systems to a direction more perpendicular to diffusing web, which resulted in the diffusing web distributing the airflow in a more evenly distributed radial pattern exiting the diffusing web.

What is claimed is:

1. A diffuser for redirecting a flow of fluid into a dispersed pattern, the diffuser comprising:

a frame for disposing the diffuser within a path of flowing fluid; and a web containing an array of pores mounted in the frame and not containing any angled vanes or louvers, the web for changing the direction of the fluid upon exiting the web to flow laterally to and radially outward from the web.

2. The diffuser of claim 1, wherein the web is composed of an essentially non-combustible material and is coated with a soil-resistant non-combustible composition.

3. The diffuser of claim 1, wherein the web is composed of an essentially combustible material, coated with a non-combustible composition.

4. The diffuser of claim 1, wherein the web is composed of an essentially combustible material, coated with a soil-resistant composition.

5. The diffuser of claim 1, wherein the web is composed of an essentially non-combustible material, coated with a non-combustible composition.

6. The diffuser of claim 1, wherein the web is composed of an essentially non-combustible material, coated with a soil-resistant composition.

7. The diffuser of claim 1, wherein the web is flat, composed of an essentially combustible material, and is coated with a soil-resistant, non-combustible composition.

8. The diffuser of claim 1, wherein the web is coated with a composition selected from the group consisting of PTFE, silicone, epoxy, polyimide, polyamide, elastomer, NHBR, neoprene, EPDM, thermoplastic elastomers, polyurethane, aqueous-based polymer, solvent based polymer, halogenated plastic, non-halogenated plastic and blends thereof.

9. The diffuser of any of claims 2, 4 or 6, wherein the soil-resistant composition is a low surface energy polymer.

10. The diffuser of claim 9, wherein the soil-resistant composition comprises a fluoropolymer selected from the group consisting of FEP, PVDF, PFA, THV, PTFE, PCTFE, FKM, FFKK and blends thereof.

11. The diffuser of claim 1, wherein the frame is rectangular in shape and wherein the web is a fabric having warp and fill yarns extending diagonally across the frame.

12. The diffuser of claim 1, wherein the frame is non-rectangular in shape and wherein the web is a fabric having warp and fill yarns extending diagonally across the frame.

13. The diffuser of claim 1, wherein the frame is non-rectangular in shape and wherein the web is a fabric having warp and fill yarns extending non-diagonally across the frame.

14. The diffuser of claim 1, wherein the frame is rectangular in shape and wherein the web is a fabric having warp and fill yarns extending non-diagonally across the frame.

15. The diffuser of claim 1, wherein a portion of the web is blocked to redirect the flow of air traveling laterally and radially outward.

16. The diffuser of claim 15, wherein the web is blocked with a perforated blocking agent.

17. The diffuser of claim 15, wherein the web is blocked with a slotted blocking agent.

18. The diffuser of claim 15, wherein the web is blocked with a moveable blocking device.

19. The diffuser of claim 15, wherein the web is blocked by a combination of two or more stationary or moving blocking agents superimposed.

20. The diffuser of claim 1, wherein the web comprises a material selected from the group consisting of fiberglass, plastic, nylon, thermoplastic polymers, thermoset polymers, elastomeric polymers, elastoplastic polymers, fluoroplastic, fluoroelastomer, polyester, PVC, polyethylene, polypropylene, PEEK, acrylic polymers, polystyrene, ABS, PPS, Polyaramid, fibrillated PTFE, metal, ceramic, carbon fibers, natural fibers, synthetic fibers, woven fibers, non-woven fibers and blends and composites thereof.

21. The diffuser of claim 20, wherein the web further comprises a material capable of generating heat under applied electric current.

22. The diffuser of claim 20, further comprising a material capable of generating heat under applied electric current disposed in proximity to the web.

23. The diffuser of claim 1, wherein the surface of the web is treated with a surface active agent, a biocide, a fluorinated surfactant, an antistatic coating, a water repellent coating, a stain repellent coating, a coating capable of generating heat, an electrically conductive coating or a dye or any combination thereof.

24. The diffuser of claim 1, wherein the fluid is a gas.

25. The diffuser of claim 1, wherein the fluid is aqueous.

26. The diffuser of claim 1, wherein the fluid is nonaqueous.

27. The diffuser of claim 1, wherein the fluid is an aqueous and nonaqueous blend.

28. The diffuser of claim 24, wherein the gas is air.

29. The diffuser of claim 1, further comprising means for heating the fluid exiting the web.

30. The diffuser of claim 1, wherein the web is coated with a material capable of controlling the static electric charge of the web surface.

31. The diffuser of claim 1, wherein the surface of the web is planar.

32. The diffuser of claim 1, wherein the surface of the web is non-planar.

33. A system for diffusing air comprising:

a diffuser for redirecting a flow of air into a dispersed pattern, the diffuser comprising:

a frame for mounting the diffuser to a backpan attached to an air supply duct; and a pore-containing web mounted in the frame, the web for changing the direction of the air upon exiting the web to flow laterally to and radially outward from the web, the web composed of a fibrous or polymeric material, the web comprising an array of openings and not comprising any angled vanes or louvers for changing the direction of the air upon exiting the web; and said air duct supplying air at an angle to the diffuser through said backpan.

34. A system for diffusing air comprising:

a diffuser for redirecting a flow of air into a dispersed pattern, the diffuser comprising:

a frame for mounting the diffuser to a backpan attached to an air supply duct; and a pore-containing web mounted in the frame, the web for changing the direction of the air upon exiting the web to flow laterally to and radially outward from the web, the web composed of a fibrous or polymeric material, the web comprising an array of openings and not comprising any angled vanes or louvers for changing the direction of the air upon exiting the web; and said air duct supplying air essentially normal to the diffuser through said backpan.

35. A system for diffusing air comprising:

a diffuser for redirecting the flow of air in a dispersed pattern, the diffuser comprising:

a frame for mounting the diffuser to a backpan attached to an air supply duct; and a pore-containing web, the web for changing the direction of the air upon exiting the web to flow laterally to and radially outward from the web, the web composed of a fibrous or polymeric material; and a means for changing the direction of the air supplied from the air supply duct to the web.

36. The system for diffusing air of any of claims 33–35, wherein a portion of said pore-containing web is blocked.

37. The system for diffusing air of claim 35 wherein the web is blocked with a perforated blocking agent.

38. The system for diffusing air of claim 35 wherein the web is blocked with a slotted blocking agent.

39. The system for diffusing air of claim 35 wherein the web is blocked with a moveable blocking device.

40. The system for diffusing air of claim 35 wherein the web is blocked by a combination of two or more stationary or moveable blocking agents superimposed.

41. A system for diffusing fluid flowing from an unenclosed space, the system comprising:

a diffuser for redirecting a flow of fluid into a dispersed pattern, the diffuser comprising:

a frame for placing the diffuser in the path of fluid flowing from an unenclosed space; and a pore-containing web mounted in the frame, the web for changing the direction of the fluid upon exiting the web to flow laterally to and radially outward from the web, the web composed of a fibrous or polymeric material, the web comprising an array of openings and not comprising any angled vanes or louvers for changing the direction of the fluid upon exiting the web; and said fluid flowing at an angle to the diffuser.

42. A system for diffusing fluid flowing from an unenclosed space, the system comprising:

a diffuser for redirecting a flow of fluid into a dispersed pattern, the diffuser comprising:

a frame for placing the diffuser in the path of fluid flowing from an unenclosed space; and a pore-containing web mounted in the frame, the web for changing the direction of the fluid upon exiting the web to flow laterally to and radially outward from the web, the web composed of a fibrous or polymeric material, the web comprising an array of openings and not comprising any angled vanes or louvers for changing the direction of the fluid upon exiting the web; and said fluid flowing essentially normal to the diffuser.

* * * * *